US009636925B2

(12) United States Patent
Fukazawa et al.

(10) Patent No.: US 9,636,925 B2
(45) Date of Patent: May 2, 2017

(54) RECORDING APPARATUS AND RECORDING METHOD

(71) Applicant: Seiko Epson Corporation, Tokyo (JP)

(72) Inventors: Masahiro Fukazawa, Chino (JP); Naoki Sudo, Shiojiri (JP); Akito Sato, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/677,155

(22) Filed: Apr. 2, 2015

(65) Prior Publication Data

US 2015/0283823 A1 Oct. 8, 2015

(30) Foreign Application Priority Data

Apr. 3, 2014 (JP) ..... 2014-077103

(51) Int. Cl.
*B41J 29/393* (2006.01)
*B41J 2/21* (2006.01)

(52) U.S. Cl.
CPC ..... *B41J 2/2139* (2013.01)

(58) Field of Classification Search
CPC . B41J 29/393; B41J 29/38; B41J 29/02; B41J 11/42; B41J 13/02; B41J 2/04505
See application file for complete search history.

(56) References Cited

U.S. PATENT DOCUMENTS 5,581,284 A * 12/1996 Hermanson ..... B41J 2/04505 347/40
7,481,510 B2 * 1/2009 Hirano ..... B41J 2/205 347/15
7,585,045 B2 9/2009 Yamanobe

FOREIGN PATENT DOCUMENTS

JP 2008-155382 A 7/2008

* cited by examiner

*Primary Examiner* — Lamson Nguyen
(74) *Attorney, Agent, or Firm* — Harness, Dickey & Pierce, P.L.C.

(57) ABSTRACT

A recording apparatus is provided in which a recording medium and a plurality of nozzles including a plurality of nozzles for black which is lined up in a predetermined line-up direction to form black dots and a plurality of nozzles for color which is lined up in the line-up direction to form composite black dots move relatively in a relative movement direction that is different from the line-up direction. The recording apparatus includes a processing unit that forms composite black dots with a nozzle group included in the plurality of nozzles for color to complement dots which are to be formed by a failed nozzle included in the plurality of nozzles for black. The nozzle group includes a plurality of nozzles that is positioned differently in the line-up direction.

15 Claims, 21 Drawing Sheets

DISTRIBUTION RATIO TABLE T2

| | C | M | Y |
|---|---|---|---|
| UPPER RASTER | 0% | 0% | 0% |
| MISSING RASTER | 50% | 75% | 100% |
| LOWER RASTER | 50% | 25% | 0% |

DISTRIBUTION RATIO TABLE T21

| | | C | M | Y |
|---|---|---|---|---|
| | UPPER RASTER | 0% | 0% | 0% |
| (R31 < R41) | MISSING RASTER | R31 | R41 | 100% |
| (R32 > R42) | LOWER RASTER | R32 | R42 | 0% |

DISTRIBUTION RATIO TABLE T22

| | | C | M | Y |
|---|---|---|---|---|
| | UPPER RASTER | 0% | 0% | 0% |
| (R51 < R61 = 100%) | MISSING RASTER | R51 | 75% | R61 |
| (R52 > R62 = 0%) | LOWER RASTER | R52 | 25% | R62 |

COMPOSITE COMPLEMENTATION

FIG. 9A

CMY CORRECTION VALUE TAGLE T1

| K | C | M | Y |
|---|---|---|---|
| 0 | 0 | 0 | 0 |
| ⋮ | ⋮ | ⋮ | ⋮ |
| GKi | GCi | GMi | GYi |
| ⋮ | ⋮ | ⋮ | ⋮ |
| 255 | | | |

FIG. 9B

DISTRIBUTION RATIO TABLE T2

| | C | M | Y |
|---|---|---|---|
| UPPER RASTER | RC1% | RM1% | RY1% |
| MISSING RASTER | RCL% | RML% | RYL% |
| LOWER RASTER | RC2% | RM2% | RY2% |

FIG. 9C

DISTRIBUTION RATIO TABLE T2A

| | C | M | Y |
|---|---|---|---|
| UPPER RASTER | RC3% | RM3% | RY3% |
| UPPER RASTER | RC1% | RM1% | RY1% |
| MISSING RASTER | RCL% | RML% | RYL% |
| LOWER RASTER | RC2% | RM2% | RY2% |
| LOWER RASTER | RC4% | RM4% | RY4% |

FIG. 10

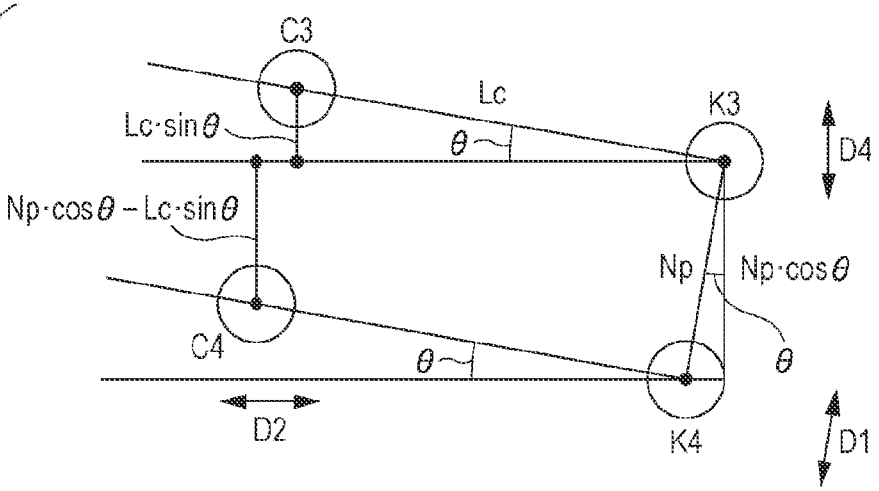

DISTRIBUTION RATIO OF C3 $R21 = \frac{Np \cdot \cos\theta - Lc \cdot \sin\theta}{Np \cdot \cos\theta}$ DISTRIBUTION RATIO OF C4 $R22 = \frac{Lc \cdot \sin\theta}{Np \cdot \cos\theta}$ DISTRIBUTION RATIO OF M3 $R21 = \frac{Np \cdot \cos\theta - Lm \cdot \sin\theta}{Np \cdot \cos\theta}$ DISTRIBUTION RATIO OF M4 $R22 = \frac{Lc \cdot \sin\theta}{Np \cdot \cos\theta}$ DISTRIBUTION RATIO OF Y3 $R21 = \frac{Np \cdot \cos\theta - Ly \cdot \sin\theta}{Np \cdot \cos\theta}$ DISTRIBUTION RATIO OF Y4 $R22 = \frac{Lc \cdot \sin\theta}{Np \cdot \cos\theta}$

FIG. 11A

DISTRIBUTION RATIO TABLE IN CASE OF $\theta(2) < \theta \leq \theta(3)$

| | C | M | Y |
|---|---|---|---|
| UPPER RASTER | 0% | 0% | 0% |
| MISSING RASTER | 50% | 70% | 80% |
| LOWER RASTER | 50% | 30% | 20% |

FIG. 11B

DISTRIBUTION RATIO TABLE IN CASE OF $\theta(1) < \theta \leq \theta(2)$

| | C | M | Y |
|---|---|---|---|
| UPPER RASTER | 0% | 0% | 0% |
| MISSING RASTER | 80% | 90% | 100% |
| LOWER RASTER | 20% | 10% | 0% |

FIG. 11C

DISTRIBUTION RATIO TABLE IN CASE OF $\theta(-1) \leq \theta \leq \theta(1)$

| | C | M | Y |
|---|---|---|---|
| UPPER RASTER | 0% | 0% | 0% |
| MISSING RASTER | 0% | 0% | 0% |
| LOWER RASTER | 0% | 0% | 0% |

FIG. 11D

DISTRIBUTION RATIO TABLE IN CASE OF $\theta(-2) \leq \theta < \theta(-1)$

| | C | M | Y |
|---|---|---|---|
| UPPER RASTER | 20% | 10% | 0% |
| MISSING RASTER | 80% | 90% | 0% |
| LOWER RASTER | 0% | 0% | 0% |

FIG. 11E

DISTRIBUTION RATIO TABLE IN CASE OF $\theta(-3) \leq \theta < \theta(-2)$

| | C | M | Y |
|---|---|---|---|
| UPPER RASTER | 50% | 30% | 20% |
| MISSING RASTER | 50% | 70% | 80% |
| LOWER RASTER | 0% | 0% | 0% |

FIG. 17

UPPER 50% DISTRIBUTION TABLE

| | | | | | | | | |
|---|---|---|---|---|---|---|---|---|
| UPPER RASTER → | 0 | +1 | 0 | +1 | 0 | +1 | 0 | +1 |
| MISSING RASTER → | +1 | 0 | +1 | 0 | +1 | 0 | +1 | 0 |
| LOWER RASTER → | 0 | 0 | 0 | 0 | 0 | 0 | 0 | 0 |

UPPER 25% DISTRIBUTION TABLE

| | | | | | | | | |
|---|---|---|---|---|---|---|---|---|
| UPPER RASTER → | 0 | +1 | 0 | 0 | 0 | +1 | 0 | 0 |
| MISSING RASTER → | +1 | 0 | +1 | +1 | +1 | 0 | +1 | +1 |
| LOWER RASTER → | 0 | 0 | 0 | 0 | 0 | 0 | 0 | 0 |

LOWER 25% DISTRIBUTION TABLE

| | | | | | | | | |
|---|---|---|---|---|---|---|---|---|
| UPPER RASTER → | 0 | 0 | 0 | 0 | 0 | 0 | 0 | 0 |
| MISSING RASTER → | +1 | 0 | +1 | +1 | +1 | 0 | +1 | +1 |
| LOWER RASTER → | 0 | +1 | 0 | 0 | 0 | +1 | 0 | 0 |

LOWER 50% DISTRIBUTION TABLE

| | | | | | | | | |
|---|---|---|---|---|---|---|---|---|
| UPPER RASTER → | 0 | 0 | 0 | 0 | 0 | 0 | 0 | 0 |
| MISSING RASTER → | +1 | 0 | +1 | 0 | +1 | 0 | +1 | 0 |
| LOWER RASTER → | 0 | +1 | 0 | +1 | 0 | +1 | 0 | +1 |

T30

+

300

| | | | | | | | |
|---|---|---|---|---|---|---|---|
| 0 | 0 | 1 | 1 | 2 | 2 | 3 | 3 |
| 0 | 0 | 1 | 1 | 2 | 2 | 3 | 3 |
| 0 | 0 | 1 | 1 | 2 | 2 | 3 | 3 |

310

| | | | | | | | |
|---|---|---|---|---|---|---|---|
| 0 | 0 | 1 | 1 | 2 | 2 | 3 | 3 |
| 1 | 0 | 2 | 1 | 3 | 2 | 3 | 3 |
| 0 | 1 | 1 | 2 | 2 | 3 | 3 | 3 |

FIG. 20A

DISTRIBUTION RATIO TABLE IN CASE OF $L(1) \leq L1 < L(2)$

| | C | M | Y |
|---|---|---|---|
| UPPER RASTER | 0% | 0% | 0% |
| MISSING RASTER | 50% | 70% | 80% |
| LOWER RASTER | 50% | 30% | 20% |

FIG. 20B

DISTRIBUTION RATIO TABLE IN CASE OF $L(2) \leq L1 < L(3)$

| | C | M | Y |
|---|---|---|---|
| UPPER RASTER | 0% | 0% | 0% |
| MISSING RASTER | 80% | 90% | 100% |
| LOWER RASTER | 20% | 10% | 0% |

FIG. 20C

DISTRIBUTION RATIO TABLE IN CASE OF $L(3) \leq L1 \leq L(4)$

| | C | M | Y |
|---|---|---|---|
| UPPER RASTER | 0% | 0% | 0% |
| MISSING RASTER | 0% | 0% | 0% |
| LOWER RASTER | 0% | 0% | 0% |

FIG. 20D

DISTRIBUTION RATIO TABLE IN CASE OF $L(4) < L1 \leq L(5)$

| | C | M | Y |
|---|---|---|---|
| UPPER RASTER | 20% | 10% | 0% |
| MISSING RASTER | 80% | 90% | 0% |
| LOWER RASTER | 0% | 0% | 0% |

FIG. 20E

DISTRIBUTION RATIO TABLE IN CASE OF $L(5) < L1 \leq L(6)$

| | C | M | Y |
|---|---|---|---|
| UPPER RASTER | 50% | 30% | 20% |
| MISSING RASTER | 50% | 70% | 80% |
| LOWER RASTER | 0% | 0% | 0% |

RECORDING APPARATUS AND RECORDING METHOD

CROSS-REFERENCE TO RELATED APPLICATIONS

This application claims priority to Japanese Patent Application No. 2014-077103 filed on Apr. 3, 2014. The entire disclosure of Japanese Patent Application No. 2014-077103 is hereby incorporated herein by reference.

BACKGROUND

1. Technical Field

The present invention relates to a recording apparatus and a recording method.

2. Related Art

An ink jet printer forms dots on a printing medium by relatively moving the printing medium (recording medium) and a recording head in which nozzle arrays for, for example, cyan (C), magenta (M), yellow (Y), and black (K) are lined up in a relative movement direction to discharge ink droplets (liquid droplets) from nozzles according to data representing presence or absence of a dot for each pixel. Examples of the ink jet printer include a line printer and a serial printer.

When ink droplets are not discharged from nozzles due to clogging and the like or are discharged but do not draw correct trajectories, this may cause a "dot missing" area that is formed by pixels where dots are not formed being connected in the relative movement direction and cause white streaks in a printing image. Particularly, streaks of the color of the printing medium tend to stand out when failed nozzles that fail to discharge ink droplets exist in the nozzle array for black (K). To suppress such streaks, it is considered that other nozzles form dots to complement dots that are to be formed by failed nozzles for K. However, there is no proposal for an appropriate technology for complementing dots that are to be formed by failed nozzles for K when the recording head is inclined.

The subject matter disclosed in JP-A-2008-155382 deals with an image forming method, although not a technology for complementing dots that are to be formed by failed nozzles, that decreases visibility of non-uniform streaks when the recording head is mounted in an inclined manner. The image forming method disposes subnozzle arrays for the nozzle arrays for only C and M among CMYK in the ink jet recording head and measures the amount of inclination of the recording head to deposit droplets with a part of or all subnozzles included in the subnozzle arrays instead of depositing droplets with a part of or all main nozzles included in the main nozzle arrays when the obtained amount of inclination exceeds a threshold.

JP-A-2008-155382 does not have a suggestion for complementing dots that are to be formed by failed nozzles and does not have a description for depositing droplets with subnozzles for K. In addition, preparing subnozzles in the recording head as a measure against the inclining of the recording head leads to an increase in cost. Therefore, referring to the technology disclosed in JP-A-2008-155382 does not reach an appropriate technology for complementing dots that are to be formed by failed nozzles for K when the recording head is inclined.

The problem described above also resides in various recording apparatuses.

SUMMARY

An advantage of some aspects of the invention is to provide a technology that can appropriately complement dots which are to be formed by failed nozzles for black without preparing subnozzles used instead of nozzles for black.

According to an aspect of the invention, there is provided a recording apparatus in which a recording medium and a plurality of nozzles including a plurality of nozzles for black which is lined up in a predetermined line-up direction to form black dots and a plurality of nozzles for color which is lined up in the line-up direction to form composite black dots move relatively in a relative movement direction that is different from the line-up direction, the recording apparatus including a processing unit that forms composite black dots with a nozzle group included in the plurality of nozzles for color to complement dots which are to be formed by a failed nozzle included in the plurality of nozzles for black, in which the nozzle group includes a plurality of nozzles that is positioned differently in the line-up direction.

The aspect described above can provide a technology that can appropriately complement dots which are to be formed by failed nozzles for black without preparing subnozzles used instead of nozzles for black.

Furthermore, the invention can be applied to a composite apparatus that includes the recording apparatus, a recording method that includes processes corresponding to each unit described above, a processing method for a composite apparatus that includes the recording method, a recording program that realizes functions corresponding to each unit described above in a computer, a processing program for a composite apparatus that includes the recording program, a computer-readable medium on which these programs are recorded, and the like. The apparatus described above may be configured by a plurality of distributed components.

BRIEF DESCRIPTION OF THE DRAWINGS

The invention will be described with reference to the accompanying drawings, wherein like numbers reference like elements.

FIG. 9A is a schematic diagram illustrating the structure of a CMY correction value table, and FIGS. 9B and 9C are schematic diagrams illustrating the structure of a distribution ratio table.

FIG. 10 is a schematic diagram describing an example of distribution of recording densities of color inks.

FIGS. 11A to 11E are schematic diagrams illustrating examples of the structure of the distribution ratio table that stores distribution ratios that are in accordance with an amount of inclination.

FIG. 17 is a schematic diagram illustrating an example of the structure of a distribution table that stores information which is in accordance with the amount of inclination and illustrating an example of the recording data in which complementing dots are formed on the basis of the distribution table.

FIGS. 20A to 20E are schematic diagrams illustrating examples of the structure of the distribution ratio table that stores distribution ratios that are in accordance with a distance between lines.

DESCRIPTION OF EXEMPLARY EMBODIMENTS

Figure 1:
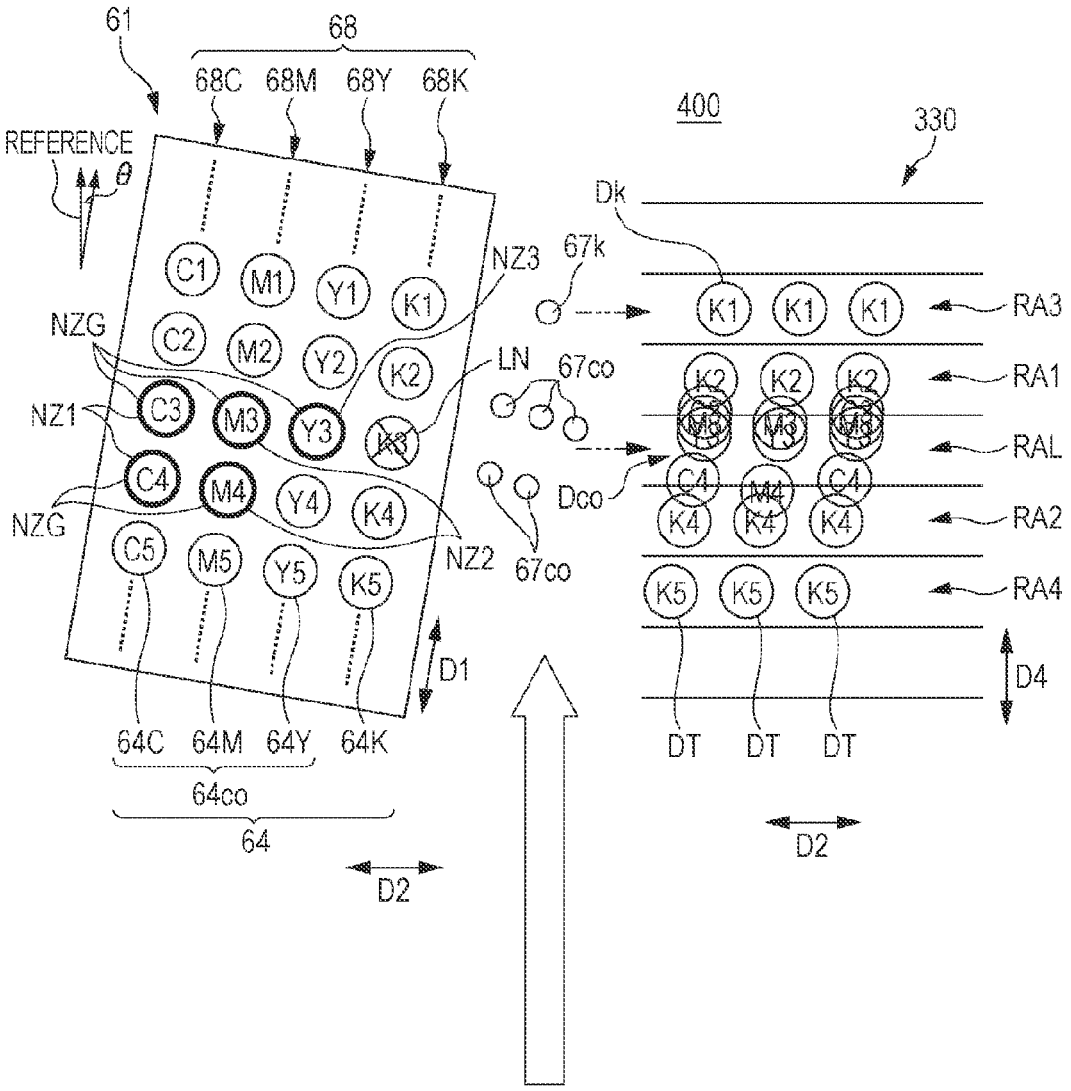
FIG. 1 is a schematic diagram illustrating an example of composite complementation when a recording head is inclined.

An embodiment of the invention will be described hereinafter. It is apparent that the following embodiment is provided merely for illustrative purposes of the invention. Not all of the features illustrated in the embodiment are necessarily required for the solution of the invention.

(1) Outline Of Present Technology

First, an outline of the present technology will be described with reference to FIGS. 1 to 21B.

A recording apparatus 1 in the present technology is provided with a plurality of nozzles 64 that includes a plurality of nozzles for K 64K and a plurality of nozzles for color 64*co*. The plurality of nozzles for K 64K is lined up in a line-up direction D1 and forms black (K) dots Dk. The plurality of nozzles for color ink 64*co* is lined up in the line-up direction D1 and forms composite black dots Dco. The plurality of nozzles 64 (recording head 61) and a recording medium 400 move relatively in a relative movement direction D2 that is different from the line-up direction D1. The relative movement of the plurality of nozzles and the recording medium includes a case where the recording medium moves while the plurality of nozzles does not move, a case where the plurality of nozzles moves while the recording medium does not move, and a case where both of the plurality of nozzles and the recording medium move. A line printer is a representative example of a recording apparatus in which a recording medium moves while a plurality of nozzles does not move when discharging liquid droplets to form dots.

The recording apparatus 1 is provided with a processing unit U1. The processing unit U1 forms the composite black dots Dco with a nozzle group NZG included in the plurality of nozzles for color 64*co*. The composite black dots Dco complement dots that are to be formed by a failed nozzle LN included in the plurality of nozzles for K 64K. The nozzle group NZG includes a plurality of nozzles (nozzle sets NZ1 and NZ2) that is positioned differently in the line-up direction D1.

A recording method in the present technology forms dots by moving the plurality of nozzles 64 and the recording medium 400 relatively in the relative movement direction D2 that is different from the line-up direction D1. The plurality of nozzles 64 includes the plurality of nozzles for K 64K that is lined up in the predetermined line-up direction D1 and forms the K dots Dk and the plurality of nozzles for color 64*co* that is lined up in the line-up direction D1 and forms the composite black dots Dco. The recording method forms the composite black dots Dco with the nozzle group NZG that is included in the plurality of nozzles for color 64*co* and includes a plurality of nozzles (the nozzle sets NZ1 and NZ2) positioned differently in the line-up direction D1. The composite black dots Dco complement dots that are to be formed by the failed nozzle LN included in the plurality of nozzles for K 64K.

Accordingly, the present embodiment can suppress a streak 800 (refer to FIG. 2) caused by the failed nozzle LN for K because the nozzle group NZG included in the plurality of nozzles for color 64*co* forms the dots Dco that complement dots which are to be formed by the failed nozzle LN for K. In addition, the present embodiment can further suppress the streak 800 caused by the failed nozzle LN for K even when the recording head 61 is inclined because the nozzle group NZG forming the complementing dots Dco includes a plurality of nozzles (the nozzle sets NZ1 and NZ2) that is positioned differently in the line-up direction D1. Furthermore, the present embodiment can suppress shifting of the color of the composite black dot Dco caused by inclination of the recording head 61.

According to at least a part of the description hereinbefore, the present embodiment can provide a technology that can appropriately complement dots which are to be formed by the failed nozzle LN for K without preparing subnozzles used instead of the nozzles for K.

Color inks producing composite black include a cyan (C) ink, a magenta (M) ink, a yellow (Y) ink, a light cyan (lc) ink, a light magenta (lm) ink, a dark yellow (DY) ink, a red (R) ink, an orange (Or) ink, a green (Gr) ink, a violet (V) ink, and the like. Mixed colors of colors selected from these colors can be used as colors producing composite black. Although mixed colors of CMY are preferred, other colors except mixed colors of CMY, for example, mixed colors of CM and the like may also be used.

A nozzle is a small hole that ejects a liquid droplet (ink droplet). Failure to discharge a liquid droplet includes clogging that is a phenomenon of blocking of a nozzle. A dot is the minimum unit of a recording result that is formed on a recording medium by a liquid droplet.

Figure 3:
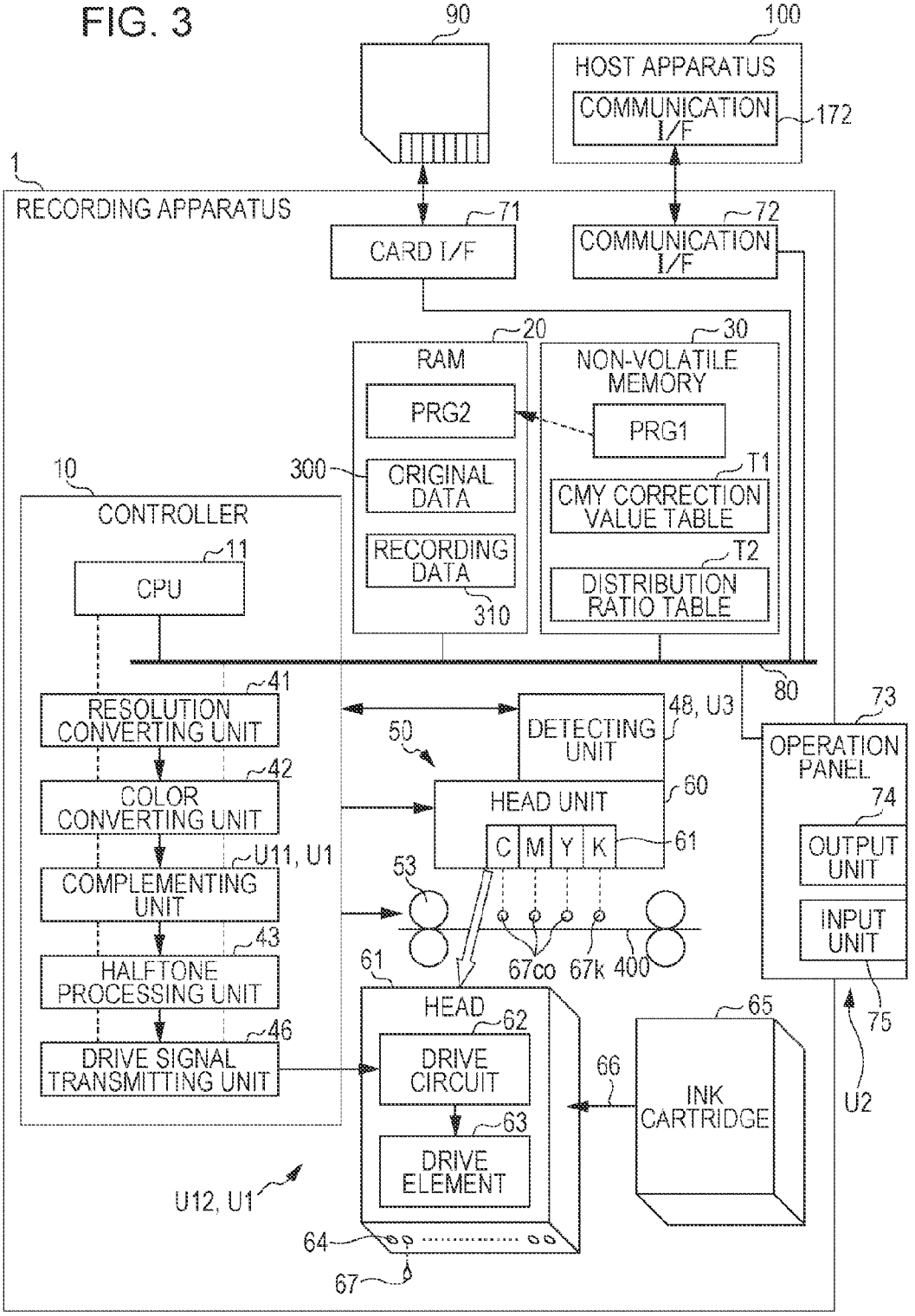
FIG. 3 is a schematic diagram illustrating an example of the configuration of a line printer as a recording apparatus.

The processing unit U1 may include a complementing unit U11 as illustrated in FIG. 3. The complementing unit U11 generates recording data 310 on the basis of original data 300 that is before complementation of dots which are to be formed by the failed nozzle LN. The composite black dots Dco are formed in the recording data 310 to complement dots that are to be formed by the failed nozzle LN. The processing unit U1 may include a dot forming unit U12 that forms dots DT with the plurality of nozzles 64 on the basis of the recording data 310. The complementing unit U11 may convert the recording density of K ink (corresponding to a gradation value GKi illustrated in FIG. 9A) that is to be used in recording by the failed nozzle LN among the recording densities of K ink represented in the original data 300 into the recording density of complementing color ink that is used in recording by the nozzle group NZG and may generate the recording data 310 that includes the obtained recording density of complementing color ink. The present embodiment can provide an appropriate technology for complementing dots that are to be formed by the failed nozzle LN for K because the recording density of K ink (GKi) that is to be used in recording by the failed nozzle LN is converted into the recording density of complementing color ink that is used in recording by the nozzle group NZG, and the recording density of complementing color ink is included in the recording data 310.

The recording density includes both data before halftone and data after halftone. The recording density means multilevel gradation data before halftone (a gradation value representing one of 256 gradations in the example in FIG. 9A) and means a probability of forming a dot at a pixel after halftone. A pixel is the minimum element constituting an image and can be assigned a color independently.

The recording density before halftone represents, when focusing on a pixel in a printing image, the amount of use of each ink of CMYK before halftone at the focused pixel. The multilevel gradation data before halftone changes to multi-valued data such as two-valued or four-valued data after the number of gradations is decreased through a halftone process. Thus, the multi-valued data after halftone does not represent the amount of use of ink for each pixel. When the multilevel gradation data having the same value is stored at multiple pixels before halftone, the probability of forming a dot at each of these pixels becomes a probability that is in accordance with the recording density through the halftone process such as dithering.

Figure 21A:
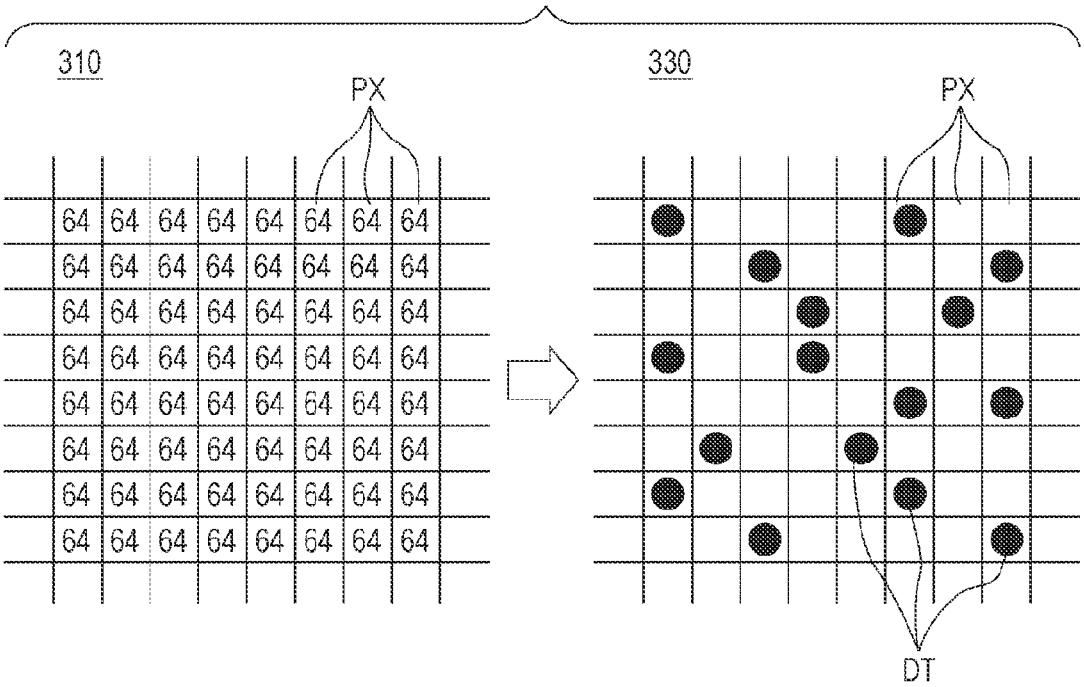
FIGS. 21A and 21B are schematic diagrams illustrating how a printing image is formed by generating the halftone data from the recording data before halftone that stores gradation values representing recording densities.
Figure 21B:
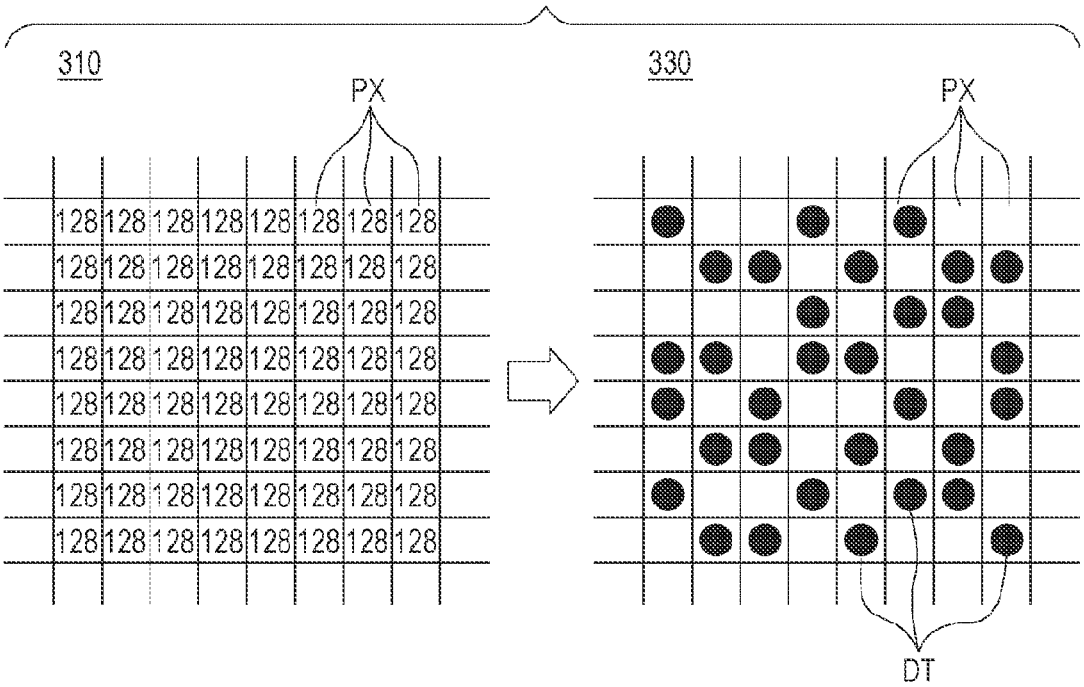

FIGS. 21A and 21B schematically illustrates, as an example for describing the recording density, how a printing image 330 is formed by generating two-valued data (halftone data) from the gradation values of 0 to 255 before halftone (recording data 310) for one color among CMYK. Apparently, the pattern of the dots DT included in the printing image 330 is merely for illustrative purposes. As illustrated in FIG. 21A, when the probability of discharging an ink droplet to each pixel PX having 64 as a gradation value representing one of 256 gradations before halftone is set to 25%, the dot DT is formed at 25% of these pixels PX. As illustrated in FIG. 21B, when the probability of discharging an ink droplet to each pixel PX having 128 as a gradation value representing one of 256 gradations before halftone is set to 50%, the dot DT is formed at 50% of these pixels PX. Therefore, the recording density after halftone means a probability of discharging an ink droplet 67 to the pixel PX and means a ratio of the number of probabilistically formed dots DT to the number of pixels PX in a predetermined area in a case of the same recording density in the predetermined area. The recording density can be represented by weighting a discharging probability with a ratio of weight to the maximum amount of an ink droplet when the amount of an ink droplet discharged from a nozzle varies. For example, when the ratio of weight of a medium dot to a large dot is ½, the recording density can be represented as 50×½=25% by converting medium dots formed at 50% of all pixels to large dots.

The complementing unit U11 may set the recording density of complementing color inks used in recording by each of a plurality of nozzles (nozzle sets NZ1 and NZ2), which is included in the nozzle group NZG and is positioned differently in the line-up direction D1, to distribution ratios (for example, R21 and R22) that are in accordance with the amount of inclination θ with respect to a reference of the line-up direction D1 of the plurality of nozzles for K 64K and the plurality of nozzles for color 64*co*. The present embodiment can further appropriately complement dots that are to be formed by the failed nozzle LN for K because the complementing recording density distributed to each nozzle in the nozzle sets NZ1 and NZ2 becomes a distribution ratio that is in accordance with the amount of inclination θ with respect to the reference of the line-up direction D1 of nozzles.

Figure 5:
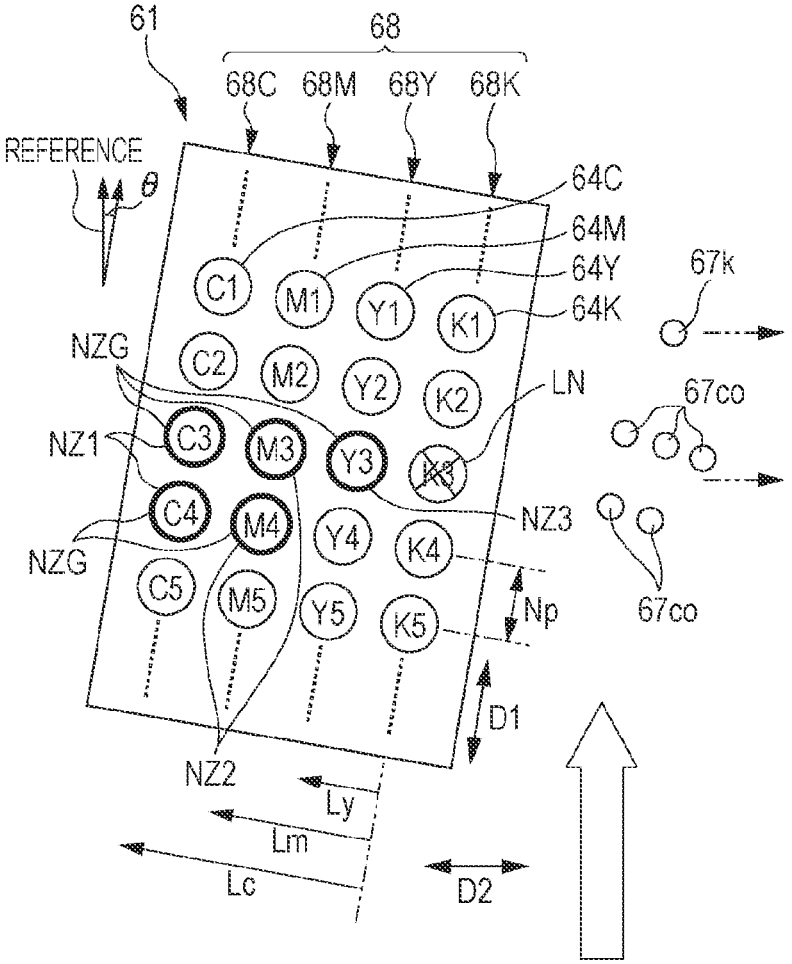
FIG. 5 is a schematic diagram describing an example of a distribution ratio of recording densities of color inks.

As illustrated in FIG. 5, the nozzle group NZG may include the first nozzle set NZ1 that is a plurality of nozzles positioned differently in the line-up direction D1 at a predetermined distance from an array 68K of the plurality of nozzles for K 64K. In addition, the nozzle group NZG may include the second nozzle set NZ2 that is a plurality of nozzles positioned differently in the line-up direction D1 closer to the array 68K of the plurality of nozzles for K 64K than the first nozzle set NZ1. The complementing unit U11 may set, among the distribution ratios (for example, R31 and R32) of the recording densities of complementing color inks used in recording by each nozzle in the first nozzle set NZ1, the distribution ratio R31 corresponding to a nozzle that has the same position as the failed nozzle LN in the line-up direction D1 (for example, the nozzle C3 in FIG. 5) to be less than, among the distribution ratios (for example, R41 and R42) of the recording densities of complementing color inks used in recording by each nozzle in the second nozzle set NZ2, the distribution ratio R41 corresponding to a nozzle that has the same position as the failed nozzle LN in the line-up direction D1 (for example, the nozzle M3 in FIG. 5). When the line-up direction D1 of the nozzle 64 is inclined, the position of forming of a dot by a nozzle, in the first nozzle set NZ1, that has the same position as the failed nozzle LN in the line-up direction D1 (for example, the nozzle C3) is further displaced in the line-up direction D1 than the position of forming of a dot by a nozzle, in the second nozzle set NZ2, that has the same position as the failed nozzle LN in the line-up direction D1 (for example, the nozzle M3) from the position of forming of a dot that is to be formed by the failed nozzle LN. From this, by setting R31<R41, the present embodiment can further appropriately complement dots that are to be formed by the failed nozzle LN for K.

The nozzle group NZG may include the first nozzle set NZ1 that is a plurality of nozzles positioned differently in the line-up direction D1 at a predetermined distance from the array 68K of the plurality of nozzles for K 64K. In addition, the nozzle group NZG may include the third nozzle NZ3 that has the same position as the failed nozzle LN in the line-up direction D1 and is closer to the array 68K of the plurality of nozzles for K 64K than the first nozzle set NZ1. The complementing unit U11 may distribute the recording densities of complementing color inks (correspond to, for example, the gradation values GCi, GMi, and GYi illustrated in FIG. 9A) that are collectively assigned to the first nozzle set NZ1 to each nozzle in the first nozzle set NZ1 and may not distribute the recording densities of complementing color inks (GCi, GMi, and GYi) that are collectively assigned to the third nozzle NZ3 to the third nozzle NZ3. Since the recording densities of complementing color inks are not distributed to the third nozzle NZ3, the third nozzle NZ3 is configured by one nozzle. When the line-up direction D1 of the nozzle 64 is inclined, the position of forming of a dot by a nozzle, in the first nozzle set NZ1, that has the same position as the failed nozzle LN in the line-up direction D1 (for example, the nozzle C3 in FIG. 5) is further displaced in the line-up direction D1 than the position of forming of a dot by the third nozzle NZ3 from the position of forming of a dot that is to be formed by the failed nozzle LN. Therefore, the present embodiment can further appropriately complement dots that are to be formed by the failed nozzle LN for K.

The recording data 310 may be gradation data that represents recording densities of K ink and color ink. The dot forming unit U12 may decrease the number of gradations in the gradation data to generate the halftone data 315 (refer to FIG. 15) that represents a forming status of dots. In addition, the dot forming unit U12 may form the dots DT with the plurality of nozzles 64 on the basis of the halftone data 315. Since dots are formed on the basis of the halftone data 315 that is generated from the gradation data to which the recording densities of color inks used in recording by the nozzle group NZG are added, the present embodiment can further appropriately complement dots that are to be formed by the failed nozzle LN for K.

The recording apparatus 1 may be provided with an inclination amount input unit U2 that receives input of information which represents the amount of inclination θ with respect to the reference of the line-up direction D1 of the plurality of nozzles for K 64K and the plurality of nozzles for color 64*co*. The complementing unit U11 may set the recording density of complementing color inks used in recording by each of a plurality of nozzles (nozzle sets NZ1 and NZ2), which is included in the nozzle group NZG and is positioned differently in the line-up direction D1, to the distribution ratios that are in accordance with the amount of inclination θ which is represented by the information input to the inclination amount input unit U2. By inputting information that represents the amount of inclination θ, the present embodiment sets the complementing recording density that is distributed to each nozzle in the nozzle sets NZ1 and NZ2 to the distribution ratio that is in accordance with the amount of inclination θ which is represented by the information input to the inclination amount input unit U2 even when the amount of inclination θ is changed by replacement and the like of the head 61. Therefore, the present embodiment can improve convenience of use and can maintain the accuracy of complementation of dots that are to be formed by the failed nozzle LN for K even when the amount of inclination θ is changed.

(2) Specific Example Of Recording Apparatus and Recording Method

Hereinafter, a description will be provided for a line printer, as a specific example, in which a recording medium moves while a recording head does not move when forming dots by discharging ink droplets.

Figure 2:
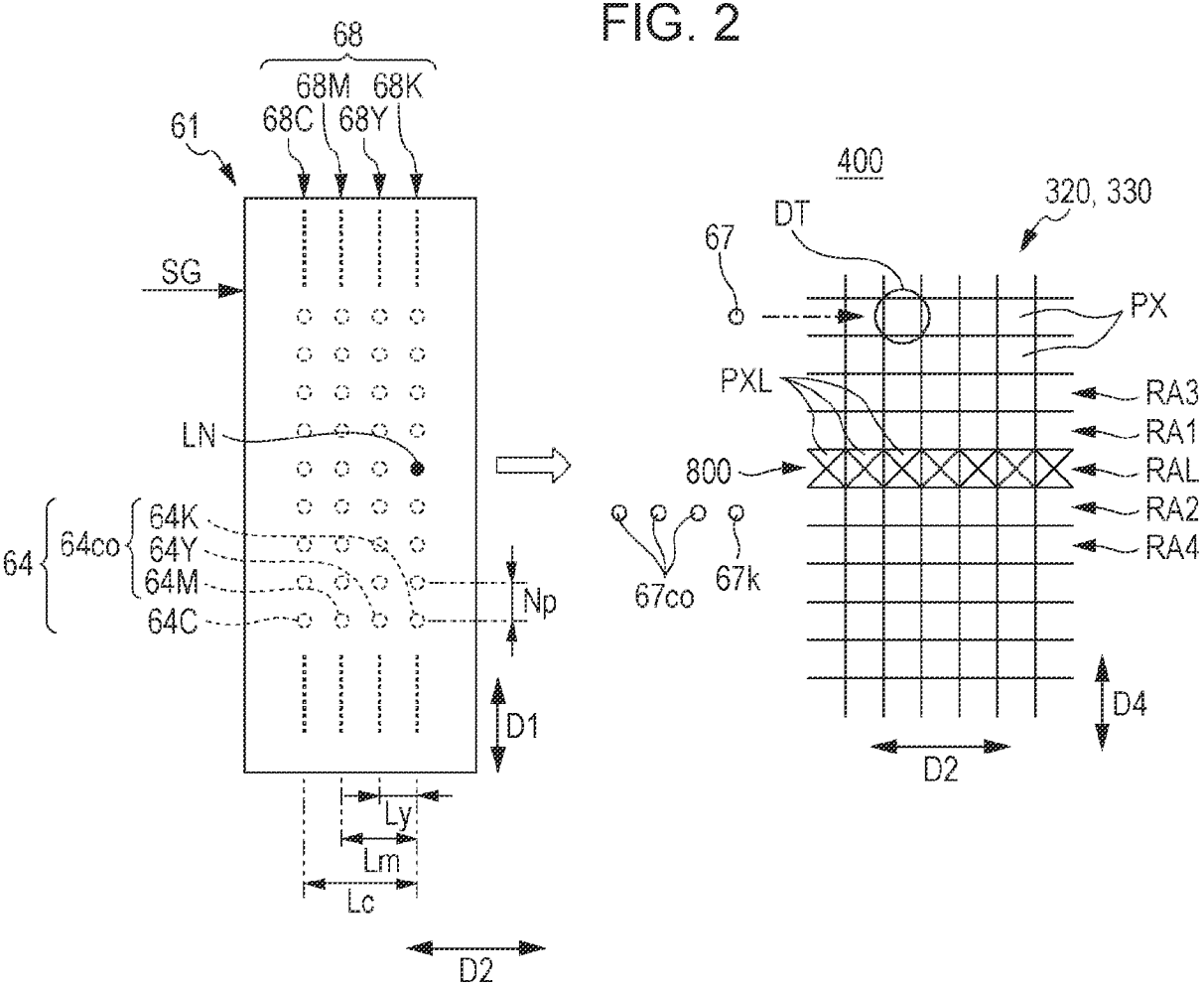
FIG. 2 is a schematic diagram illustrating an example of a correspondence between nozzles and pixels.
Figure 4:
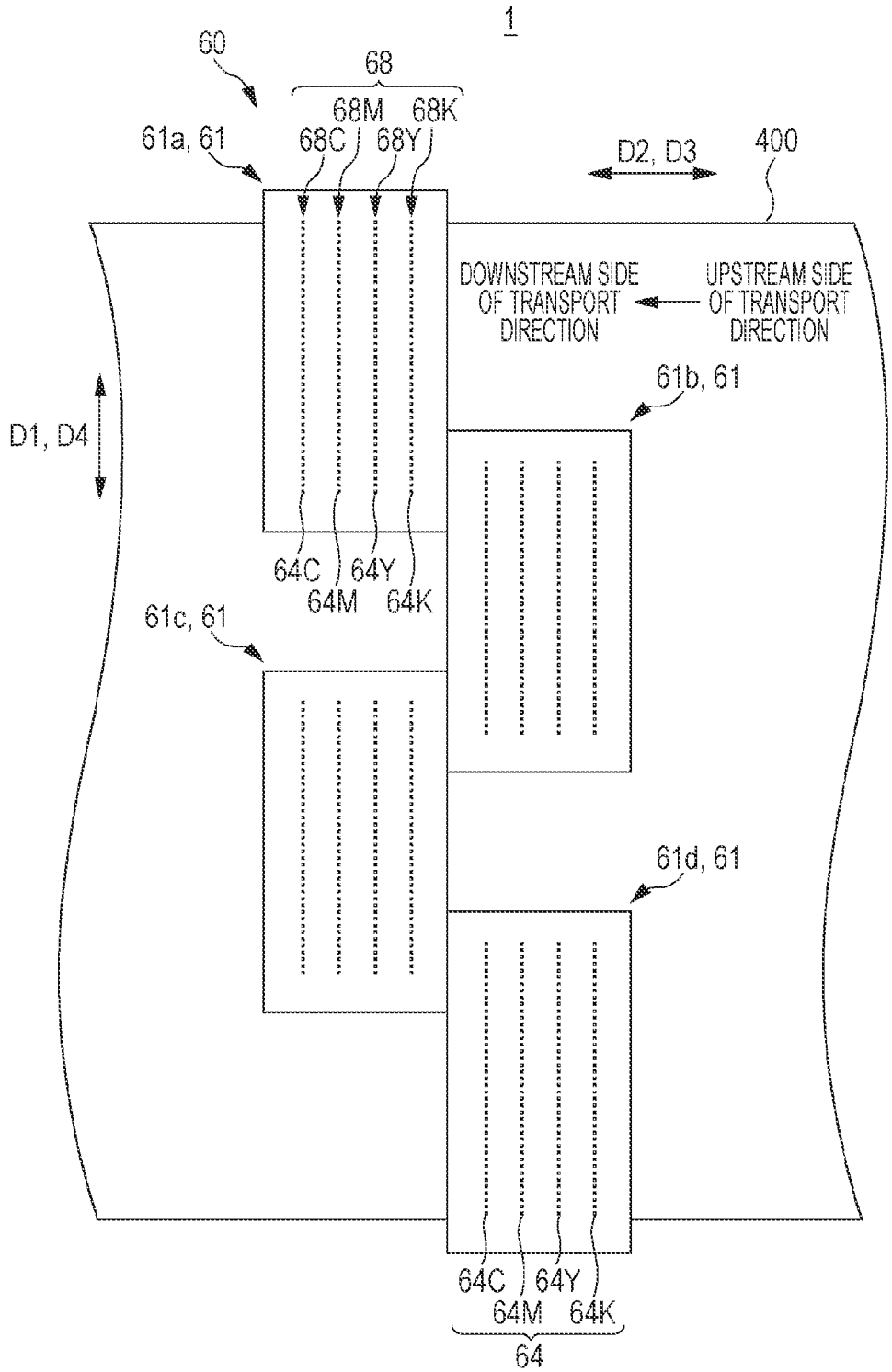
FIG. 4 is a schematic diagram illustrating main portions of the line printer as the recording apparatus.

FIG. 1 schematically illustrates an example of composite complementation in the present technology when the recording head 61 is inclined in a line printer. FIG. 2 schematically illustrates an example of a correspondence between the nozzles 64 and the pixels PX. FIG. 3 schematically illustrates an example of the configuration of the line printer as the recording apparatus 1. FIG. 4 schematically illustrates main portions of the line printer as the recording apparatus 1. FIG. 5 is a schematic diagram for describing an example of a distribution ratio of the recording densities of color inks.

In the present specification, the sign D1 indicates the line-up direction of the nozzles 64. The sign D3 indicates the transport direction of the recording medium 400 which is a printing medium. The sign D2 indicates the relative movement direction of the head 61 with the transported recording medium 400 as a reference. The sign D4 indicates the width direction of the long recording medium 400. As illustrated in FIG. 4, dots are formed on the recording medium 400 sequentially from the downstream side of the transport direction to the upstream side of the transport direction when the recording medium 400 moves from the upstream side of the transport direction to the downstream side of the transport direction while the head 61 is fixed. The line-up direction D1 and the width direction D4 match in the examples in FIG. 1 and the like but may be displaced at approximately 45° or the like. These directions D1 and D4 and the relative movement direction D2 (transport direction D3) may desirably be different from each other. The invention includes not only a case where the directions D1 and D4 are orthogonal to the direction D2 (D3) but also a case where the directions D1 and D4 intersect with the direction D2 (D3) not orthogonally, for example, approximately at 45°. Apparently, the intersection of two direction means a displacement of two directions including an orthogonal displacement thereof. The magnification of each direction may be different in each drawing, and the drawings may not be coordinated with each other for easy understanding. In addition, the inclination of the head 61 illustrated in FIG. 1 and the like is depicted in an exaggerated manner and is different from the actual inclination. Dots illustrated in FIG. 1 and the like are schematically illustrated for descriptive purposes only. The size, the shape, and the like of dots actually formed are not necessarily the same as those in the drawings. The head 61 illustrated in FIGS. 1 to 6A and the like is also schematically illustrated for descriptive purposes only. The size, the shape, and the like thereof are not necessarily the same as those in the drawings. Furthermore, the pixel PX illustrated in FIG. 2 represents the calculative hitting position of the ink droplet (liquid droplet) 67 discharged (ejected) from the head 61 that is not inclined. The hitting position of the ink droplet 67 is displaced from the calculative position when the head 61 is inclined.

A printing medium is a material that holds a printing image. A printing medium generally has a shape of a rectangle and also has a shape of a circle (for example, optical discs such as a CD-ROM and a DVD), a triangle, a quadrangle, a polygon, and the like. A printing medium includes at least all types and processed products of paper or paperboard disclosed in Japanese Industrial Standards (JIS) P0001:1998 (vocabulary regarding paper, paperboard, and pulp). A printing medium also includes a resin sheet, a metal plate, a three-dimensional object, and the like.

The recording apparatus 1 generates the recording data 310, which represents the printing image 330 in which dots which are to be formed by the failed nozzle LN are complemented, on the basis of the original data 300 that represents a virtual image 320 before dot complementation which is not actually formed. The images 320 and 330 before and after complementation are images having multiple values or two values that represent a forming status (includes presence or absence) of the dot DT at each calculative position of the pixels PX which are lined up orderly in each of the relative movement direction D2 and the width direction D4. The printing image 330 is an image that is actually formed on the recording medium 400.

First, a description will be provided for an example of a correspondence between the nozzles 64 and the pixels PX. A head unit 60 illustrated in FIG. 4 is provided with the recording head 61 that includes a nozzle array for C 68C, a nozzle array for M 68M, a nozzle array for Y 68Y, and the nozzle array for K 68K. There is no limitation on the order of colors of the nozzle arrays in the relative movement direction D2. Each of the nozzle arrays 68C, 68M, 68Y, and 68K is lined up in the transport direction D3 of the recording medium 400 such as a printing paper. Nozzles 64C, 64M, 64Y, and 64K are respectively lined up in the nozzle arrays 68C, 68M, 68Y, and 68K in the line-up direction D1. The nozzle for K 64K discharges an ink droplet for K 67*k*. The nozzle for C 64C, the nozzle for M 64M, and the nozzle for Y 64Y discharge CMY ink droplets 67*co* that produce composite black. The ratio of recording densities of CMY inks producing composite black is not particularly limited and, for example, can be set to 1:1:1. In a case where the ratio of recording densities is 1:1:1, and the gradation value (recording density) for K before halftone at a dot loss pixel PXL in which a dot is to be formed by the failed nozzle LN is 128 (50%), all of the recording densities become 50% when the gradation value for K is represented by the gradation value for CMY as (C, M, Y)=(128, 128, 128). Here, when nozzles for C C3 and C4 are used as the first nozzle set NZ1 as illustrated in FIG. 1, the complementation value for C 128 is distributed to the pixels that correspond to the nozzles C3 and C4. When nozzles for M M3 and M4 are used as the second nozzle set NZ2, the complementation value for M 128 is distributed to the pixels that correspond to the nozzles M3 and M4. When only a nozzle Y3 is used for Y, the complementation value for Y 128 is assigned to the pixel that corresponds to the nozzle Y3. The complementation value is added to the original gradation value for CMY because a pixel before complementation has an original gradation value for CMY.

A plurality of heads (tips) 61*a* to 61*d* is arranged in the head unit 60 illustrated in FIG. 4 so that the dots DT can be formed on the recording medium 400 by the ink droplets 67 discharged (ejected) from the nozzles 64C, 64M, 64Y, and 64K across the entire recording medium 400 in the width direction D4. The heads 61*a* to 61*d* are collectively called the head 61, the nozzle arrays 68C, 68M, 68Y, and 68K are collectively called a nozzle array 68, and the nozzles 64C, 64M, 64Y, and 64K are collectively called the nozzle 64 here.

The present technology also includes a case of a nozzle array in which nozzles are arranged in a zigzag form because a plurality of nozzles is lined up in, for example, two arrays in a predetermined line-up direction that is different from a transport direction. The line-up direction in this case means the direction of lining up of nozzles in each array in the zigzag arrangement.

The head 61 illustrated in FIG. 2 and the like is schematically illustrated on the opposite side thereof from a nozzle surface having the nozzle 64 so as to be aligned with the printing image 330. The nozzle array 68 may have the failed nozzle LN that does not discharge ink droplets due to clogging and the like or discharges ink droplets which do not draw correct trajectories. When the failed nozzle LN exists, this causes a "dot missing" area (missing raster RAL) that is formed on the recording medium 400 by the dot loss pixels PXL where the dots DT are not formed being connected in the relative movement direction D2. In the present technology, a raster means pixels that are continuously and linearly lined up in the relative movement direction D2. When dots are not formed in the missing raster RAL, this causes the streak 800 of the color of the recording medium 400 to occur in the printing image 330. When the recording medium 400 is white, white streaks occur.

In the present technology, both rasters that are adjacent to the missing raster RAL are called primary vicinity rasters RA1 and RA2. A raster that is adjacent to the primary vicinity raster RA1 on the opposite side of the primary vicinity raster RA1 from the missing raster RAL is called a secondary vicinity raster RA3. A raster that is adjacent to the primary vicinity raster RA2 on the opposite side of the primary vicinity raster RA2 from the missing raster RAL is called a secondary vicinity raster RA4. Here, the pitch of each nozzle 64 in the nozzle array 68 is represented by Np. The distance between the nozzle array 68K and the nozzle array 68Y is represented by Ly. The distance between the nozzle array 68K and the nozzle array 68M is represented by Lm. The distance between the nozzle array 68K and the nozzle array 68C is represented by Lc. The nozzles for color 64C, 64M, and 64Y are collectively called the nozzle for color ink 64*co*.

The recording apparatus 1 illustrated in FIG. 3 is provided with a controller 10, a random access memory (RAM) 20, a non-volatile memory 30, a failed nozzle detecting unit 48, a mechanism unit 50, interfaces (I/F) 71 and 72, an operating panel 73, and the like. A bus 80 connects the controller 10, the RAM 20, the non-volatile memory 30, the I/Fs 71 and 72, and the operating panel 73 so that information can be input and output therebetween.

The controller 10 is provided with a central processing unit (CPU) 11, a resolution converting unit 41, a color converting unit 42, the complementing unit U11, a halftone processing unit 43, a drive signal transmitting unit 46, and the like. The controller 10 constitutes the dot forming unit U12 along with the mechanism unit 50 and constitutes a failed nozzle detector U3 along with the failed nozzle detecting unit 48. The controller 10 can be configured by a system on a chip (SoC) and the like.

The CPU 11 is a device that mainly performs information processing and control in the recording apparatus 1.

The resolution converting unit 41 converts the resolution of an input image from a host apparatus 100, a memory card 90, and the like into a setting resolution (for example, 600 dpi in the transport direction D3 and 1200 dpi in the relative movement direction D2). The input image, for example, is represented by RGB data that has an integer value for 256 gradations of red, green, and blue (RGB) at each pixel.

The color converting unit 42, for example, converts the RGB data in the setting resolution into CMYK data having an integer value for 256 gradations of CMYK at each pixel. The CMYK data is the original data 300 before complementing dots that are to be formed by the failed nozzle LN in the present embodiment.

The complementing unit U11 generates the recording data 310 on the basis of the original data 300. The composite black dots Dco that complement dots which are to be formed by the failed nozzle LN are formed in the recording data 310. The recording data 310 is gradation data that represents recording densities of K ink and color ink. The complementing unit U11 will be described in detail later.

The halftone processing unit 43 generates halftone data 315 by decreasing the number of gradations of the gradation value through a predetermined halftone process such as dithering for the gradation value of each pixel constituting the recording data 310. The halftone data 315 is data that represents a forming status of dots. The halftone data 315 may be two-valued data representing whether to form a dot or not or may be multi-valued data having three or more gradations that can correspond to each different size of dots such as large, medium, and small dots. Two-valued data that can be represented by one bit for each pixel can be set by, for example, associating forming of a dot with 1 and non-forming of a dot with 0. Four-valued data that can be represented by two bits for each pixel can be set by, for example, associating forming of a large dot with 3, forming of a medium dot with 2, forming of a small dot with 1, and non-forming of a dot with 0. The halftone data 315 may be multi-valued data without having forming of a large dot when a large dot is dedicatedly used as a complementing dot.

The drive signal transmitting unit 46 generates a drive signal SG from the halftone data 315, the drive signal SG corresponding to a voltage signal applied to a drive element 63 of the head 61, and outputs the drive signal SG to a drive circuit 62. For example, the drive signal transmitting unit 46 outputs a drive signal for discharging an ink droplet for a large dot when the halftone data 315 is set to "forming of a large dot". The drive signal transmitting unit 46 outputs a drive signal for discharging an ink droplet for a medium dot when the halftone data 315 is set to "forming of a medium dot". The drive signal transmitting unit 46 outputs a drive signal for discharging an ink droplet for a small dot when the halftone data 315 is set to "forming of a small dot".

Each of the units 41, 42, U11, 43, and 46 above may be configured by an application-specific integrated circuit (ASIC) and may read data of a processing target directly from the RAM 20 or write processed data directly into the RAM 20.

The mechanism unit 50 controlled by the controller 10 is provided with a paper transport mechanism 53, the head unit 60, the head 61, and the like and constitutes the dot forming unit U12 along with the controller 10. The paper transport mechanism 53 transports the continuous recording medium 400 in the transport direction D3. The head 61, for example, discharging the ink droplets 67 of CMYK is mounted in the head unit 60. The head 61 is provided with the drive circuit 62, the drive element 63, and the like. The drive circuit 62 applies a voltage signal to the drive element 63 according to the drive signal SG that is input from the controller 10. The drive element 63 can be configured by using a piezoelectric element that applies a pressure to an ink (liquid) 66 in a pressure chamber communicating with the nozzle 64, a drive element that allows the ink droplet 67 to be discharged from the nozzle 64 by generating air bubbles with heat in the pressure chamber, or the like. The pressure chamber of the head 61 is supplied with the ink 66 from an ink cartridge (liquid cartridge) 65. A combination of the ink cartridge 65 and the head 61 is disposed for each of CMYK, for example. The ink 66 in the pressure chamber is discharged as the ink droplet 67 to the recording medium 400 from the nozzle 64 by the drive element 63. This forms the dot DT of the ink droplet 67 on the recording medium 400 such as a printing paper. The printing image 330 corresponding to the recording data 310 is formed with a plurality of dots DT by transporting the recording medium 400 in the transport direction D3, that is, moving the plurality of nozzles 64 and the recording medium 400 relatively in the relative movement direction D2. When the multi-valued data is four-valued data, the image 330 is printed by forming dots having the corresponding size represented in the multi-valued data.

The RAM 20 is a large-capacity volatile semiconductor memory and stores a program PRG2, the original data 300, the recording data 310, and the like. The program PRG2 includes a recording program that realizes the function of processes corresponding to each of the units U1 to U3 of the recording apparatus 1, a function of inputting an amount of inclination, and a function of detecting a failed nozzle in the recording apparatus 1.

The non-volatile memory 30 stores program data PRG1, a CMY correction value table T1, a distribution ratio table T2, and the like. The CMY correction value table T1, as illustrated in FIG. 9A, is an information table that defines a correspondence between the recording density of K ink (gradation value GKi) and the recording densities of color ink (gradation values GCi, GMi, and GYi) for each recording density of K ink. The distribution ratio table T2, as illustrated in FIG. 9B, is an information table that defines a ratio of distribution of the recording densities of complementing color ink (GCi, GMi, and GYi) to each of a plurality of nozzles which is positioned differently in the line-up direction D1. A worker, for example, in a factory manufacturing recording apparatuses measures the amount of inclination θ with respect to the reference of the line-up direction D1 of the nozzle array 68 and stores the distribution ratio table T2 that is in accordance with the amount of inclination θ on the non-volatile memory 30. Apparently, a user of a recording apparatus may measure the amount of inclination θ and store the distribution ratio table T2 that is in accordance with the amount of inclination θ on the non-volatile memory 30. A read-only memory (ROM), a magnetic recording medium such as a hard disk, and the like are used as the non-volatile memory 30. Loading the program data PRG1 means writing the program data PRG1 into the RAM 20 as a program that the CPU 11 can interpret.

The card I/F 71 is a circuit that writes data into the memory card 90 or reads data from the memory card 90. The memory card 90 is a non-volatile semiconductor memory in which data can be written or deleted and stores images and the like that are imaged by an imaging device such as a digital camera. An image, for example, is represented by pixel values in an RGB color space, and each pixel value of RGB, for example, is represented by the gradation value representing one of 0 to 255 with eight bits.

The communication I/F 72 is connected to a communication I/F 172 of the host apparatus 100 and inputs and outputs information to the host apparatus 100. The communication I/Fs 72 and 172 can be configured by using a Universal Serial Bus (USB) and the like. Examples of the host apparatus 100 include a computer such as a personal computer, a digital camera, a digital video camera, a cellular phone such as a smartphone, and the like.

The operating panel 73 includes an output unit 74, an input unit 75, and the like and can receive input of various instructions for the recording apparatus 1 by a user. The output unit 74, for example, is configured by a liquid crystal panel (display unit) that displays information that is in accordance with various instructions and information that indicates the state of the recording apparatus 1. The output unit 74 may output these pieces of information audibly. The input unit 75, for example, is configured by operating keys (operation input unit) such as a cursor key and a determination key. The input unit 75 may be a touch panel and the like that receive operation of a display screen. The operating panel 73 may serve as an inclination amount input unit U2 that receives input of information representing the amount of inclination θ with respect to the reference of the line-up direction D1 of the nozzle array 68.

The failed nozzle detecting unit 48, along with the controller 10, constitutes the failed nozzle detector U3 that detects whether the state of each nozzle 64 is normal or abnormal.

Figure 6A:
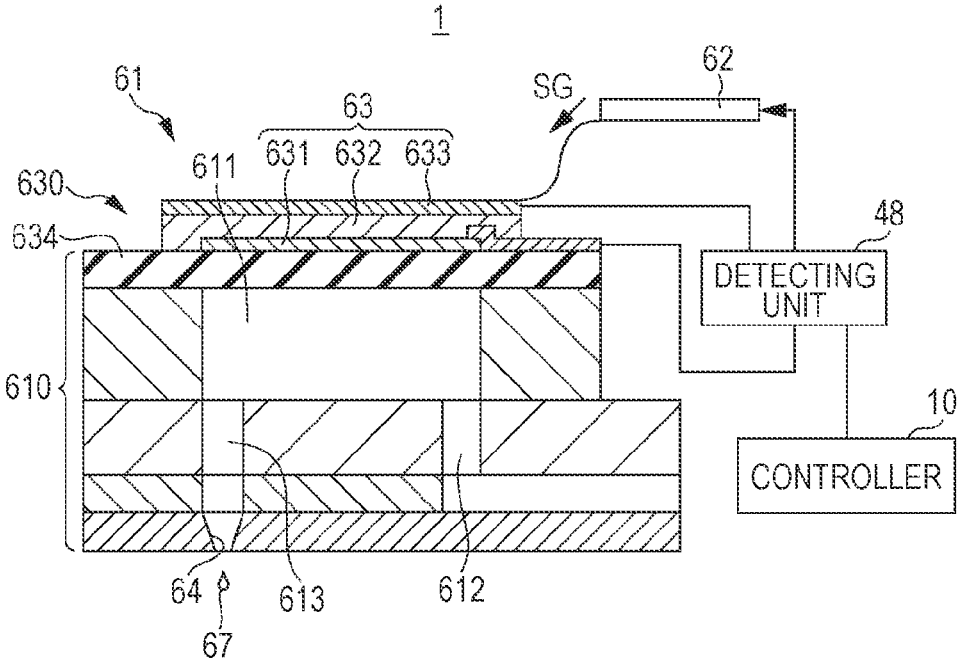
FIG. 6A is a schematic diagram illustrating main portions of the recording apparatus.
Figure 6B:
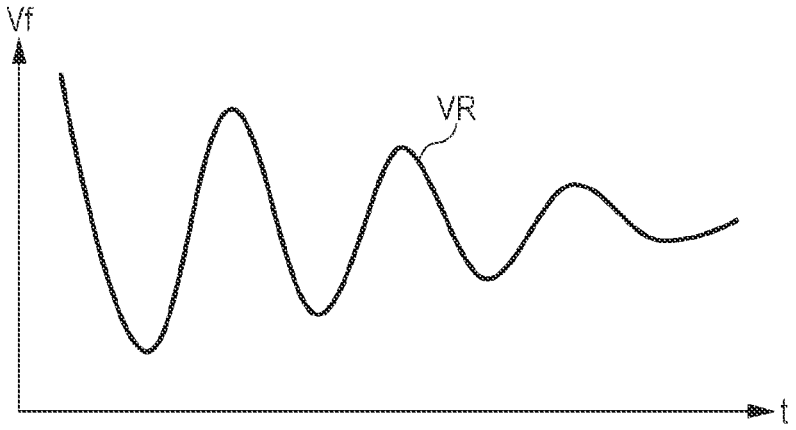
FIG. 6B is a schematic diagram illustrating a curve of electromotive force that is based on residual vibrations of a vibrating plate.
Figure 7A:
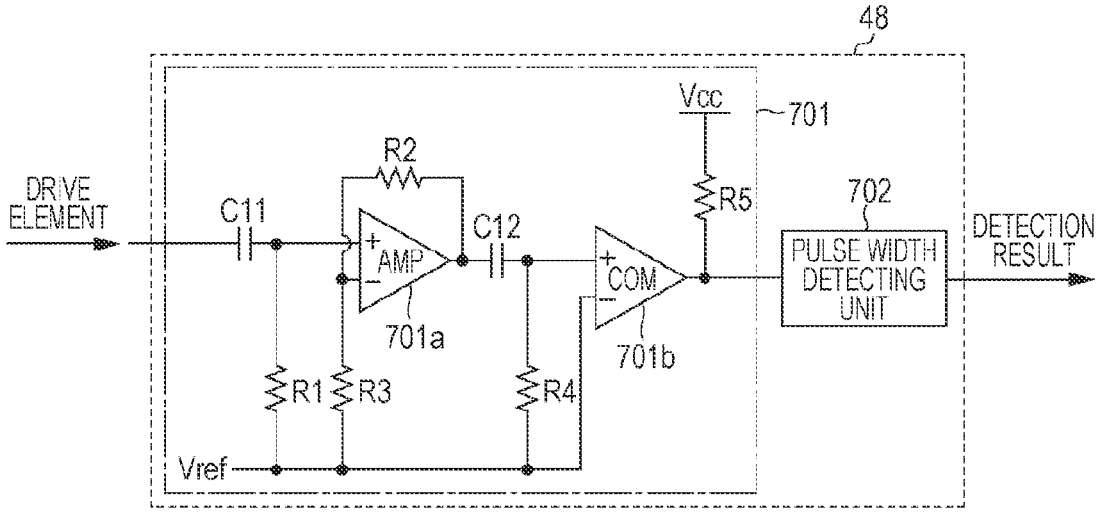
FIG. 7A is a diagram illustrating an example of electrical circuits of a failed nozzle detecting unit.
Figure 7B:
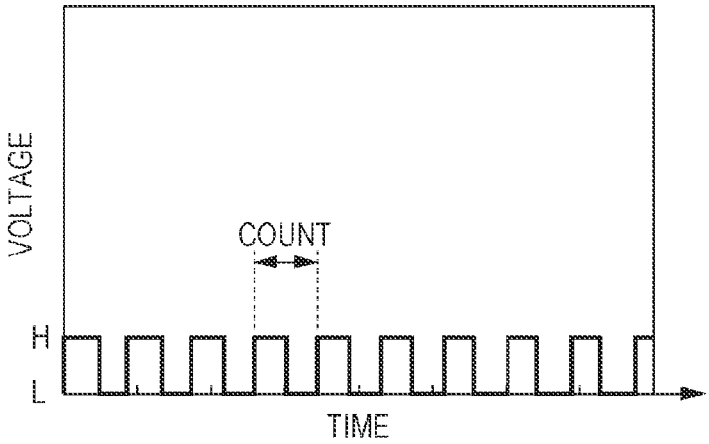
FIG. 7B is a schematic diagram illustrating an example of an output signal from an amplifying unit.

FIGS. 6A and 6B are diagrams for describing an example of a method of detecting the state of the nozzle 64. FIG. 6A schematically illustrates main portions of the recording apparatus 1. FIG. 6B schematically illustrates a curve of electromotive force VR that is based on residual vibrations of a vibrating plate 630. FIG. 7A illustrates an example of electrical circuits of the detecting unit 48. FIG. 7B schematically illustrates an example of an output signal from a comparator 701*b*.

In a channeled substrate 610 of the head 61 illustrated in FIG. 6A, a pressure chamber 611, an ink supply channel 612 through which the ink 66 flows from the ink cartridge 65 to the pressure chamber 611, a nozzle communication channel 613 through which the ink 66 flows from the pressure chamber 611 to the nozzle 64, and the like are formed. The channeled substrate 610 can be configured by using, for example, a silicon substrate and the like. A surface of the channeled substrate 610 is configured by a vibrating plate portion 634 that constitutes a part of the wall surfaces of the pressure chamber 611. The vibrating plate portion 634 can be configured of, for example, silicon oxide and the like. The vibrating plate 630 can be configured by, for example, the vibrating plate portion 634, the drive element 63 formed on the vibrating plate portion 634, and the like. The drive element 63 can be configured by, for example, a piezoelectric element and the like that include a lower electrode 631 which is formed on the vibrating plate portion 634, a piezoelectric layer 632 which is formed substantially on the lower electrode 631, and an upper electrode 633 which is formed substantially on the piezoelectric layer 632. The electrodes 631 and 633 can be configured by using, for example, platinum, gold, and the like. The piezoelectric layer 632 can be configured by using ferroelectric perovskite oxide and the like such as a PZT (lead zirconate titanate having a stoichoimetric ratio of $Pb(Zr_x, Ti_{1-x})O_3$).

FIG. 6A illustrates, as a block diagram, main portions of the recording apparatus 1 in which the detecting unit 48 detecting an electromotive state, which is based on residual vibrations of the vibrating plate 630, from a piezoelectric element (drive element 63) is disposed. One end of the detecting unit 48 is electrically connected to the lower electrode 631, and the other end of the detecting unit 48 is electrically connected to the upper electrode 633.

FIG. 6B illustrates the curve of electromotive force (electromotive state) VR of the drive element 63 that is based on residual vibrations of the vibrating plate 630 generated after supply of the drive signal SG for discharging the ink droplet 67 from the nozzle 64. The horizontal axis indicates a time t, and the vertical axis indicates an electromotive force Vf. The curve of electromotive force VR illustrates an example of discharging of the ink droplet 67 from the normal nozzle 64. The curve of electromotive force is displaced from VR when the ink droplet 67 is not discharged from the nozzle due to clogging and the like or is discharged but does not draw a correct trajectory. From this, detecting whether the nozzle 64 is normal or abnormal can be made by using a detector circuit such as the one illustrated in FIG. 7A.

The detecting unit 48 illustrated in FIG. 7A is provided with an amplifying unit 701 and a pulse width detecting unit 702. The amplifying unit 701, for example, is provided with an op-amp 701*a*, a comparator 701*b*, capacitors C11 and C12, and resistors R1 to R5. When the drive signal SG output from the drive circuit 62 is applied to the drive element 63, this generates residual vibrations, and an electromotive force based on the residual vibrations is input to the amplifying unit 701. Low-frequency components included in the electromotive force are removed by a high-pass filter configured by the capacitor C11 and the resistor R1, and the electromotive force after the removal of low-frequency components is amplified by the op-amp 701*a* at a predetermined amplification ratio. The output of the op-amp 701*a* passes through a high-pass filter configured by the capacitor C12 and the resistor R4 and is compared with a reference voltage Vref by the comparator 701*b*. The output is then converted into a pulsed voltage of a high level H or a low level L, depending on whether the output is greater than the reference voltage Vref.

FIG. 7B illustrates an example of a pulsed voltage that is output from the comparator 701*b* and is input to the pulse width detecting unit 702. The pulse width detecting unit 702 resets a count value at the time of a rise of the input pulsed voltage, increments the count value after each predetermined period, and outputs the count value as a detection result to the controller 10 at the time of the next rise of the pulsed voltage. The count value corresponds to the cycle of an electromotive force based on residual vibrations. The count values that are output sequentially indicate a frequency characteristic of an electromotive force based on residual vibrations. A frequency characteristic (for example, the cycle) of an electromotive force in a case of the failed nozzle LN is different from a frequency characteristic of an electromotive force in a case of a normal nozzle. From this, the controller 10 can determine that a nozzle of a detecting target is normal when the sequentially input count values are within an allowable range. The controller 10 can determine that a nozzle of a detecting target is the failed nozzle LN when the sequentially input count values are out of the allowable range.

By performing this process for each nozzle 64, the controller 10 can understand the state of each nozzle 64 and store information representing the position of the failed nozzle LN on, for example, the RAM 20 or the non-volatile memory 30.

Apparently, a method of detecting the failed nozzle LN is not limited to the one described above. For example, a method of detecting the failed nozzle LN also includes discharging the ink droplet 67 from the plurality of nozzles while switching a target nozzle sequentially and receiving operation of inputting information (for example, a nozzle number) for identifying nozzles that do not form dots on the recording medium 400. In addition, the failed nozzle detector U3 does not need to be disposed in the recording apparatus 1 when the information for identifying the failed nozzle LN is stored on, for example, the non-volatile memory 30 before shipment from the manufacturing factory.

Figure 8:
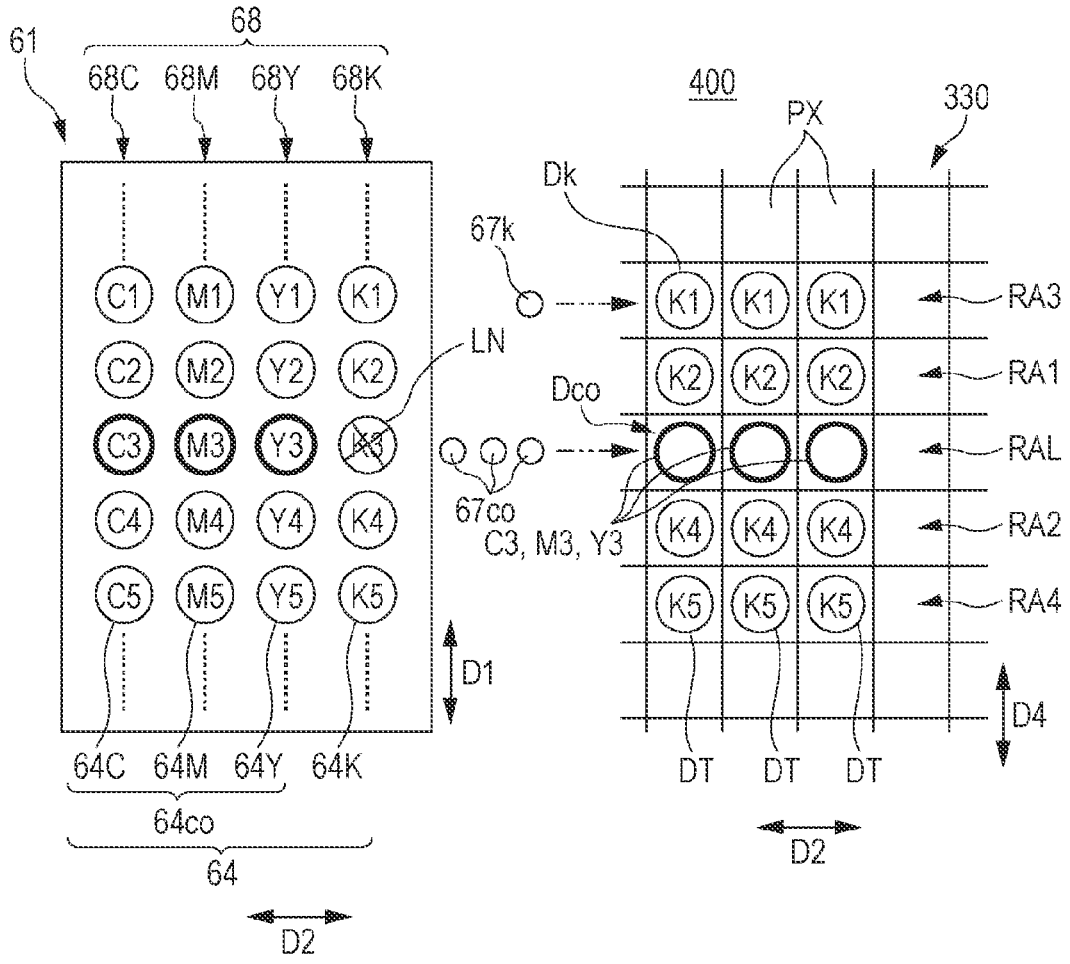
FIG. 8 is a schematic diagram describing an example of the composite complementation when the recording head is not inclined.

Next, a description will be provided for an example of the composite complementation performed by the processing unit U1. FIG. 8 is a schematic diagram describing an example of the composite complementation when the recording head 61 is not inclined. The nozzles 64C, 64M, 64Y, and 64K, each of which is continuously lined up in the nozzle arrays 68C, 68M, 68Y, and 68K in the line-up direction D1, are represented by C1 to C5, M1 to M5, Y1 to Y5, and K1 to K5. The dots DT formed by ink droplets discharged from these nozzles are given the signs of the nozzles. When the nozzle K3 is the failed nozzle LN, the nozzles C3, M3, and Y3 are the corresponding nozzles that are designed to be capable of forming the complementing dots Dco in the missing raster RAL. The nozzles C2, M2, Y2, and K2 are primary vicinity forming nozzles that can form dots in the primary vicinity raster RA1 that is adjacent to the missing raster RAL. The nozzles C4, M4, Y4, and K4 are primary vicinity forming nozzles that can form dots in the primary vicinity raster RA2 that is adjacent to the missing raster RAL. The nozzles C1, M1, Y1, and K1 are secondary vicinity forming nozzles that can form dots in the secondary vicinity raster RA3. The nozzles C5, M5, Y5, and K5 are secondary vicinity forming nozzles that can form dots in the secondary vicinity raster RA4. The dot DT is depicted to be small in FIG. 8 for easy understanding, compared with the pixel PX.

The composite complementation when the head 61 is not inclined is a process of forming, with the nozzles for color 64*co*, the dots Dco that complement K dots which are to be formed by the failed nozzle K3 in the missing raster RAL. For example, when the CMY ink droplets 67*co* are discharged from the nozzles C3, M3, and Y3 to the same pixel of the missing raster RAL, the CMY inks are mixed to form the composite black dot Dco in the missing raster RAL. When the ink droplets 67*co* having the same weight are discharged from the nozzles C3, M3, and Y3, the CMY inks are mixed at a ratio of 1:1:1 to form the composite black dot Dco. The K ink droplets 67*k* are discharged from other nozzles K1, K2, K4, and K5 except the failed nozzle K3 to form the K dots Dk.

In actuality, the head 61 may be inclined due to the line-up direction D1 of the nozzle array 68 being displaced from the reference when the head 61 is incorporated into the recording apparatus 1. FIG. 1 schematically illustrates the inclined head 61. In this case, when the CMY ink droplets 67*co* are discharged only from the corresponding nozzles C3, M3, and Y3 that are at the same position as that of the failed nozzle K3 in the line-up direction D1, the dots from the corresponding nozzles C3, M3, and Y3 are formed at a position displaced in the line-up direction D1 from the expected hitting position of a dot from the failed nozzle K3. This decreases the effect of suppressing the streak 800 occurring in the printing image 330 and causes colors to shift due to the displacement of the CMY dots in the line-up direction D1.

For this reason, the present technology uses the composite black dots Dco produced by the ink droplets 67*co* discharged from the nozzle group NZG including a plurality of nozzles that are positioned differently in the line-up direction D1 to complement dots that are to be formed by the failed nozzle LN.

The example in FIG. 1 illustrates a case where the head 61 is inclined clockwise to the right on a plane passing through the line-up direction D1 and the relative movement direction D2, and the nozzle group NZG is configured by the corresponding nozzles for C C3 and C4, the corresponding nozzles for M M3 and M4, and the corresponding nozzle for Y Y3 according to the distribution ratio table T2. The nozzles Y2 and Y4 that are adjacent to the corresponding nozzle Y3 in the line-up direction D1 are not used because the nozzle array for Y 68Y is close to (at the distance Ly illustrated in FIGS. 2 and 5 from) the nozzle array for K 68K. The nozzle C4 that is adjacent to the corresponding nozzle C3 in the line-up direction D1 is used because the nozzle array for C 68C is far from (at the distance Lc illustrated in FIGS. 2 and 5 from) the nozzle array for K 68K. The nozzle M4 that is adjacent to the corresponding nozzle M3 in the line-up direction D1 is used because the nozzle array for M 68M is closer to (at the distance Lm illustrated in FIGS. 2 and 5 from) the nozzle array for K 68K than the nozzle array for C 68C, but the distribution ratio of the recording density to the nozzle M4 (25%) is set to be less than the distribution ratio of the recording density to the nozzle C4 (50%).

FIG. 9A schematically illustrates an example of the structure of the CMY correction value table T1 that defines a correspondence between the recording density of K ink (gradation value GKi) before distribution of the recording densities of color inks to each nozzle of the nozzle group NZG and the recording densities of color inks (gradation values GCi, GMi, and GYi). Here, a description will be provided on the assumption that a gradation value increases when a recording density increases. The recording density of C ink (GCi) is distributed to the nozzles C3 and C4 as illustrated in FIG. 1 when the nozzles C3 and C4 are used for complementation. The recording density of M ink (GMi) is distributed to the nozzles M3 and M4 when the nozzles M3 and M4 are used for complementation. The recording density of Y ink (GYi) is assigned to the nozzle Y3 when only the nozzle Y3 is used for complementation.

FIG. 5 schematically illustrates features of the distribution ratio of the recording densities of color inks. In an aspect of the present technology, the nozzle group NZG illustrated in FIG. 5 includes the first nozzle set NZ1, which is a plurality of nozzles positioned differently in the line-up direction D1 at the predetermined distance Lc from the nozzle array for K 68K, and the second nozzle set NZ2, which is a plurality of nozzles positioned differently in the line-up direction D1 closer to the nozzle array 68K than the first nozzle set NZ1. Specifically, the nozzles C3 and C4 are the first nozzle set NZ1, and the nozzles M3 and M4 are the second nozzle set NZ2. As illustrated in a distribution ratio table T21, the distribution ratio of the recording density of complementing color ink used in recording by each of the nozzles C3 and C4 is set to R31 and R32, and the distribution ratio of the recording density of complementing color ink used in recording by each of the nozzles M3 and M4 is set to R41 and R42. The distribution ratios R31 and R41 correspond to the nozzles C3 and M3 that are designed to form dots in the same missing raster RAL as the failed nozzle K3. The present technology has features of R31<R41 and R32>R42. This is because the position of forming of a dot by a corresponding nozzle is greatly displaced as is farther from the nozzle array 68K as described above.

Since the relationship between the first nozzle set and the second nozzle set is relative in the present technology, it is also possible, for example, to use a plurality of nozzles for M 64M as the first nozzle set in the present technology and use a plurality of nozzles for Y 64Y as the second nozzle set in the present technology.

In another aspect of the present technology, the nozzle group NZG illustrated in FIG. 5 includes the first nozzle set NZ1, which is a plurality of nozzles positioned differently in the line-up direction D1 at the predetermined distance Lc from the nozzle array 68K, and the third nozzle NZ3, which is closer to the nozzle array 68K than the first nozzle set NZ1. Specifically, the nozzles C3 and C4 are the first nozzle set NZ1, and the nozzle Y3 is the third nozzle NZ3. As illustrated in a distribution ratio table T22, the distribution ratio of the recording density of complementing color ink used in recording by each of the nozzles C3 and C4 is set to R51 and R52, and the distribution ratio of the recording density of complementing color ink used in recording by each of the nozzles Y3 and Y4 is set to R61 and R62. The distribution ratios R51 and R61 correspond to the nozzles C3 and Y3 that are designed to form dots in the same missing raster RAL as the failed nozzle K3. The present technology has features of R51<R61=100% and R52>R62=0%. This is because the position of forming of a dot by a corresponding nozzle is greatly displaced as is farther from the nozzle array 68K as described above.

Since the relationship between the first nozzle set and the third nozzle is relative in the present technology, it is also possible, for example, to use the plurality of nozzles for M 64M as the first nozzle set in the present technology and use the nozzle for Y 64Y as the third nozzle in the present technology.

When the head 61 is inclined clockwise to the right as illustrated in FIGS. 1 and 5, at least a part of the nozzles C4, M4, and Y4 that are supposed to form dots in the lower raster RA2 may be used as the nozzle group NZG. Although not illustrated, when the head 61 is inclined counterclockwise to the left, at least a part of the nozzles C2, M2, and Y2 that are supposed to form dots in the upper raster RA1 may be used as the nozzle group NZG. Thus, the distribution ratio table T2, for example, may store distribution ratios assigned to the nozzles that are supposed to form dots in the missing raster RAL, the upper raster RA1, and the lower raster RA2 for each of CMY as illustrated in FIG. 9B. The distribution ratio table T2 illustrates that distribution ratios RC1, RCL, and RC2 are respectively assigned to the nozzles C2, C3, and C4, distribution ratios RM1, RML, and RM2 are respectively assigned to the nozzles M2, M3, and M4, and distribution ratios RY1, RYL, and RY2 are respectively assigned to the nozzles Y2, Y3, and Y4.

A distribution ratio table T2A illustrated in FIG. 9C may be used when using nozzles that are supposed to form dots in the secondary vicinity rasters RA3 and RA4 is more appropriate for complementation. The distribution ratio table T2A illustrates that distribution ratios RC3 and RC4 are respectively assigned to the nozzles C1 and C5, distribution ratios RM3 and RM4 are respectively assigned to the nozzles M1 and M5, and distribution ratios RY3 and RY4 are respectively assigned to the nozzles Y1 and Y5.

The distribution ratio table T2A is a concept that is included in the distribution ratio table T2 along with the distribution ratio tables T21 and T22.

Next, a description will be provided for a method of creating the distribution ratio table T2 with reference to FIG. 10 and the like. FIG. 10 is a schematic diagram describing an example of distribution of recording densities of color inks. Here, θ is the amount of inclination of the head 61, that is, the amount of inclination with respect to the reference of the line-up direction D1 of the plurality of nozzles for K 64K and the plurality of nozzles for color 64C, 64M, and 64Y, and Np is the pitch of the nozzles 64 in the line-up direction D1. An interval between rasters formed by the neighboring nozzles 64 (for example, the difference between the positions of the nozzles K3 and K4 in the width direction D4 of the recording medium) is Np·cos θ. The difference between the positions of the nozzle for K K3 and the corresponding nozzle for C C3 in the width direction D4 is Lc·sin θ. The difference between the positions of the nozzle for K K3 and the adjacent nozzle for C C4 in the width direction D4 is Np·cos θ−Lc·sin θ. The distribution ratios to the nozzles C3 and C4 can be obtained by the equations illustrated in FIG. 10 when the distribution ratios R21 and R22 of the recording density of C ink to the nozzles C3 and C4 are inverse ratios of the distances between each of the nozzles C4 and C3 and the nozzle K3 to Np·cos θ in the width direction D4.

$$R21=(Np\cdot\cos\theta-Lc\cdot\sin\theta)/Np\cdot\cos\theta$$

$$R22=Lc\cdot\sin\theta/Np\cdot\cos\theta$$

FIG. 10 also illustrates the equation representing the distribution ratios R21 and R22 to the nozzles for M M3 and M4 and the equation representing the distribution ratios R21 and R22 to the nozzles for Y Y3 and Y4.

It is apparent that the equations illustrated in FIG. 10 are for illustrative purposes only and may be appropriately modified, depending on characteristics and the like of the head and ink.

In addition, given the efficiency of storing the distribution ratio table T2 on the recording apparatus, the distribution ratio table may be prepared in a stepwise manner as illustrated in FIGS. 11A to 11E, depending on the amount of inclination θ.

The distribution ratio tables illustrated in FIGS. 11A to 11E are divided in a stepwise manner for thresholds θ(−3), θ(−2), θ(−1), θ(1), θ(2), and θ(3) satisfying the relationship of θ(−3)<θ(−2)<θ(−1)<0<θ(1)<θ(2)<θ(3). In a case of θ<θ(−3) or θ>θ(3), this means the inclination of the head 61 is out of the allowable range. Thus, the head 61 is excluded from products. In the examples illustrated in FIGS. 11A to 11E, a worker stores the distribution ratio table illustrated in FIG. 11A on the non-volatile memory 30 in a case of θ(2)<θ≤θ(3), stores the distribution ratio table illustrated in FIG. 11B on the non-volatile memory 30 in a case of θ(1)<θ≤θ(2), stores the distribution ratio table illustrated in FIG. 11C on the non-volatile memory 30 in a case of θ(−1)≤θ≤θ(1), stores the distribution ratio table illustrated in FIG. 11D on the non-volatile memory 30 in a case of θ(−2)≤θ<θ(−1), and stores the distribution ratio table illustrated in FIG. 11E on the non-volatile memory 30 in a case of θ(−3)≤θ<θ(−2).

Figure 12:
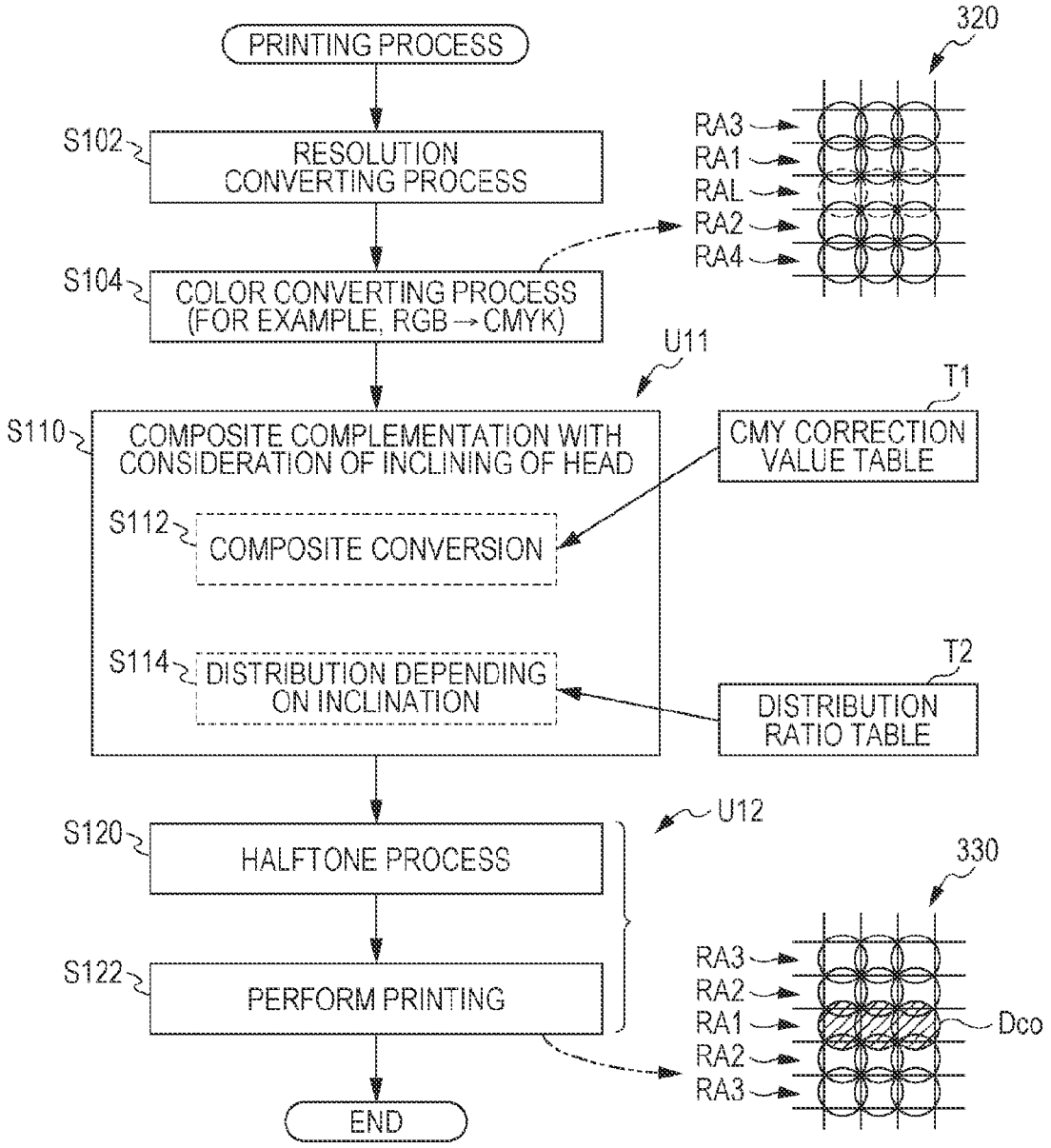
FIG. 12 is a flowchart illustrating an example of a printing process.
Figure 13:
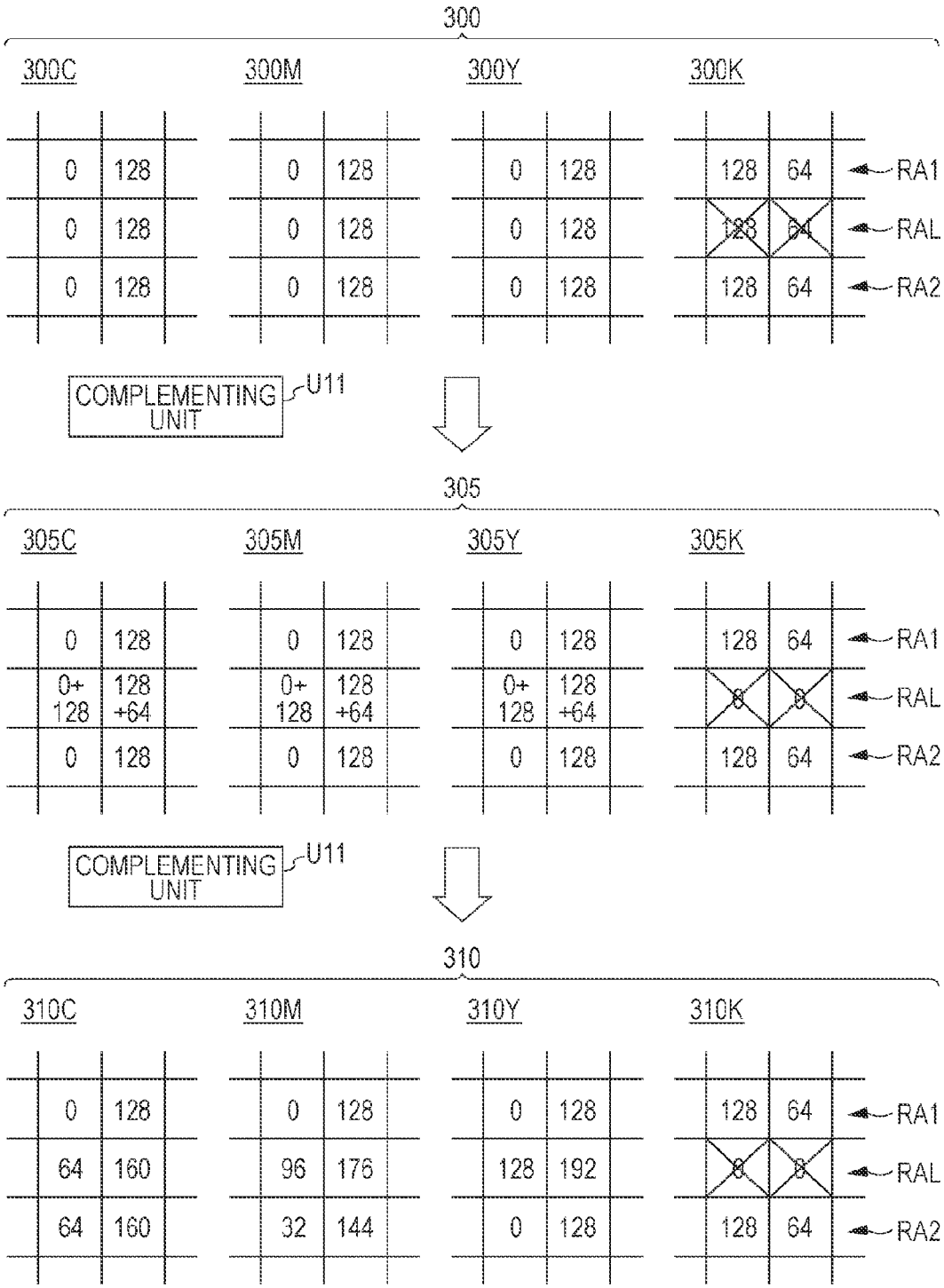
FIG. 13 is a schematic diagram illustrating how recording data is generated from original data.
Figure 14:
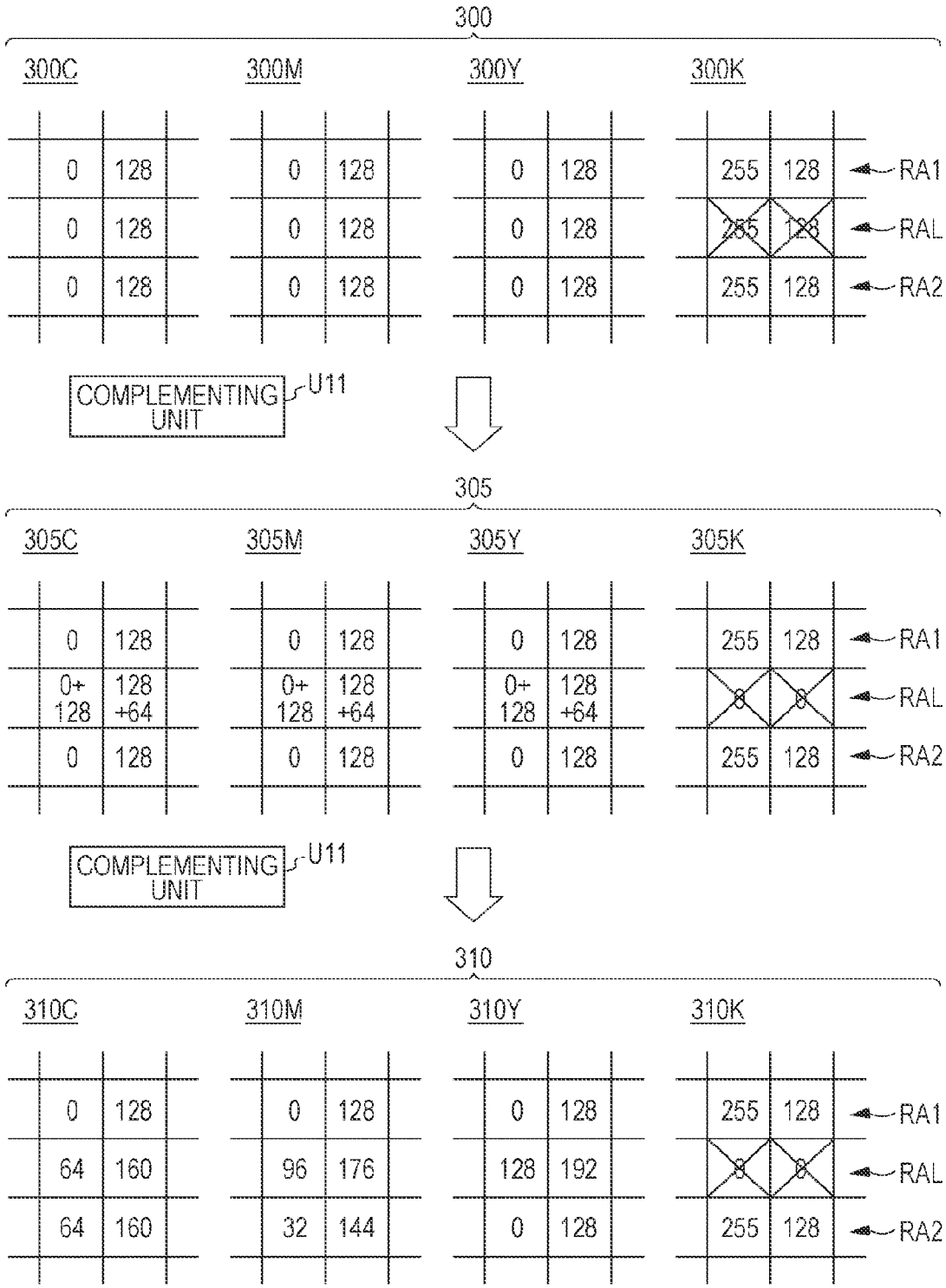
FIG. 14 is a schematic diagram illustrating an example of generation of halftone data from the recording data.

Next, a description will be provided for an example of a printing process performed by the recording apparatus 1 with reference to FIGS. 12 to 14 and the like. The units 41, 42, U11, 43, and 46 and 50 described above respectively perform processes of steps S102, S104, S110, S120, and S122 in FIG. 12 in this order for forming the printing image 330 on the basis of an input image from the host apparatus 100, the memory card 90, and the like. The word "step" will be omitted hereinafter. The printing process may be realized by electrical circuits or may be realized by programs. The controller 10 performing the process of S110 constitutes the complementing unit U11, and the controller 10 and the mechanism unit 50 performing the processes of S120 to S122 constitute the dot forming unit U12.

When the printing process starts, the resolution converting unit 41 converts the RGB data (for example, 256 gradations) representing the input image into the setting resolution (for example, 600 dpi×1200 dpi) (S102). The color converting unit 42 converts the color of the RGB data in the setting resolution into the CMYK data (for example, 256 gradations) in the same setting resolution (S104). The CMYK data is the original data 300 representing the virtual image 320 in which dots from the failed nozzle LN are not formed. The complementing unit U11 generates the recording data 310 on the basis of the original data 300. The composite black dots Dco that complement dots which are to be formed by the failed nozzle LN are formed in the recording data 310 (S110). In S110, the composite complementation is performed on the basis of the CMY correction value table T1 and the distribution ratio table T2 by taking into consideration the inclination of the head 61. First, a description will be provided for a method of performing composite conversion with reference to the CMY correction value table T1 (S112) and distributing the recording densities of color inks with reference to the distribution ratio table T2, depending on the inclination of the head 61 (S114).

As an example, the original data 300 used here is the one illustrated in FIG. 13 in which gradation values are stored in the missing raster RAL and the primary vicinity rasters RA1 and RA2 in original data for C 300C, original data for M 300M, original data for Y 300Y, and original data for K 300K. In the composite conversion in S112, the recording density of K ink (gradation value GKi) in the original data 300 is converted into the recording densities of color inks (gradation values GCi, GMi, and GYi) with reference to the CMY correction value table T1 illustrated in FIG. 9A.

Intermediate data 305 that is generated on the assumption that the recording densities of color inks are not distributed yet is illustrated in the middle part of FIG. 13. In a case of, for example, GKi=128 and GCi=GMi=GYi=128, 128 is stored at the pixels that store 0 in the missing raster RAL in pieces of intermediate data 305C, 305M, and 305Y. In a case of GKi=64 and GCi=GMi=GYi=64, 128+64=192 is stored in the pixels that store 128 in the missing raster RAL in the pieces of intermediate data 305C, 305M, and 305Y. The gradation values in the missing raster RAL in intermediate data 305K may be substituted with 0 or may remain as the original gradation value because dots are not formed in the missing raster RAL in the intermediate data 305K.

In the distribution in S114, the recording densities of color inks (gradation values GCi, GMi, and GYi) are distributed with reference to the distribution ratio table T2 illustrated in FIG. 9B when necessary. The recording data 310 that is configured by recording data for C 310C, recording data for M 310M, recording data for Y 310Y, and recording data for K 310K is illustrated in the lower part of FIG. 13. When, for example, the nozzles for C C3 and C4 are the first nozzle set NZ1 with RCL=50% and RC2=50%, a gradation value of 64 that is 50% of a gradation value of 128 is distributed to the left pixel of two pixels of the missing raster RAL, and a gradation value of 64 that is 50% of a gradation value of 128 is distributed to the left pixel of two pixels of the primary vicinity raster RA2 in the recording data 310C. FIG. 13 illustrates that the left pixels of the missing raster RAL and the primary vicinity raster RA2 in the recording data 310C store a gradation value of 64. In addition, a gradation value of 32 that is 50% of a gradation value of 64 is distributed to the right pixel of two pixels of the missing raster RAL, and a gradation value of 32 that is 50% of a gradation value of 64 is distributed to the right pixel of two pixels of the primary vicinity raster RA2 in the recording data 310C. FIG. 13 illustrates that the right pixels of the missing raster RAL and the primary vicinity raster RA2 in the recording data 310C store a gradation value of 128+32=160.

When the nozzles for M M3 and M4 illustrated in FIG. 1 are the second nozzle set NZ2 with RML=75% and RM2=25%, a gradation value of 96 that is 75% of a gradation value of 128 is distributed to the left pixel of two pixels of the missing raster RAL, and a gradation value of 32 that is 25% of a gradation value of 128 is distributed to the left pixel of two pixels of the primary vicinity raster RA2 in the recording data 310M. FIG. 13 illustrates that the left pixel of the missing raster RAL stores a gradation value of 96, and the left pixel of the primary vicinity raster RA2 stores a gradation value of 32 in the recording data 310M. In addition, a gradation value of 48 that is 75% of a gradation value of 64 is distributed to the right pixel of two pixels of the missing raster RAL, and a gradation value of 16 that is 25% of a gradation value of 64 is distributed to the right pixel of two pixels of the primary vicinity raster RA2 in the recording data 310M. FIG. 13 illustrates that the right pixel of the missing raster RAL stores a gradation value of 128+48=176, and the right pixel of the primary vicinity raster RA2 stores a gradation value of 128+16=144 in the recording data 310M.

In a case of the nozzle for Y Y3, which is not a nozzle set, illustrated in FIG. 1 and RYL=100%, a gradation value of 128 that is 100% of a gradation value of 128 is assigned to the left pixel of two pixels of the missing raster RAL in the recording data 310Y. FIG. 13 illustrates that the left pixel of the missing raster RAL in the recording data 310Y stores a gradation value of 128. In addition, a gradation value of 64 that is 100% of a gradation value of 64 is assigned to the right pixel of two pixels of the missing raster RAL in the recording data 310Y. FIG. 13 illustrates that the right pixel of the missing raster RAL in the recording data 310Y stores a gradation value of 128+64=192 (75% of the recording density).

When the sum of the gradation value for color ink for each nozzle of the nozzle group NZG and the gradation value for a pixel of the original data 300 exceeds the upper limit of a gradation value of 255, for example, the upper limit of 255 may be stored in the pixel of the recording data 310.

The amount of use of ink per pixel may be restricted because the recording medium may undulate due to ink soaked into the recording medium when the amount of use of CMYK inks per pixel is great. In this case, the CMY gradation values GCi, GMi, and GYi in the CMY correction value table T1 illustrated in FIG. 9A may be set to be less than the K gradation value GKi. As an example, the original data 300 used here is the one illustrated in FIG. 14 in which gradation values are stored in the missing raster RAL and the primary vicinity rasters RA1 and RA2 in the original data for C 300C, the original data for M 300M, the original data for Y 300Y, and the original data for K 300K. In a case of, for example, GKi=255 and GCi=GMi=GYi=128, 128 is stored at the pixels that store 0 in the missing raster RAL in the pieces of intermediate data 305C, 305M, and 305Y. In a case of GKi=128 and GCi=GMi=GYi=64, 128+64=192 is stored in the pixels that store 128 in the missing raster RAL in the pieces of intermediate data 305C, 305M, and 305Y.

Figure 15:
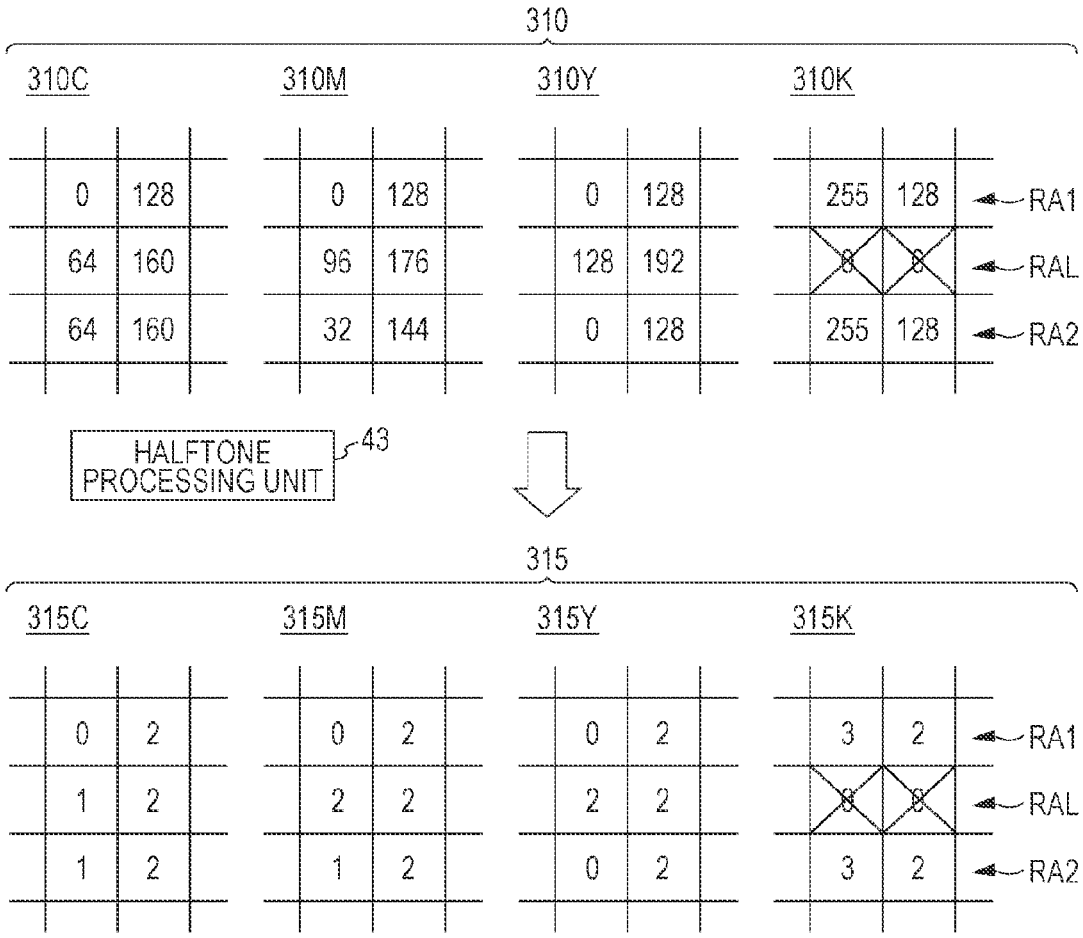
FIG. 15 is a schematic diagram illustrating another example of the generation of the halftone data from the recording data.

After generation of the recording data 310, the halftone processing unit 43 generates the halftone data 315 by performing the halftone process for the recording data 310 (S120 in FIG. 12). FIG. 15 illustrates, as the halftone data 315, four-valued data that is configured by halftone data for C 315C, halftone data for M 315M, halftone data for Y, 315Y, and halftone data for K 315K. In FIG. 15, for easy understanding, when the gradation value at a pixel in the recording data 310 based on the one in FIG. 14 is between 0 and 31, 0 (non-forming of a dot) is stored at the pixel in the halftone data 315. When the gradation value at a pixel in the recording data 310 is between 32 and 95, 1 (forming of a small dot) is stored at the pixel in the halftone data 315. When the gradation value at a pixel in the recording data 310 is between 96 and 254, 2 (forming of a medium dot) is stored at the pixel in the halftone data 315. When the gradation value at a pixel in the recording data 310 is 255, (forming of a large dot) is stored at the pixel in the halftone data 315. Even if the same gradation values are stored at pixels in the recording data 310, the gradation values stored at the pixels in the halftone data 315 may not be the same in a case of using dithering in the halftone process.

After generation of the halftone data 315, the drive signal transmitting unit 46 performs printing by generating the drive signal SG that corresponds to the halftone data 315, outputting the drive signal SG to the drive circuit 62 of the head 61, and driving the drive element 63 in accordance with the halftone data 315 to discharge the ink droplet 67 from the nozzle 64 of the head (S122). Accordingly, the printing image 330 represented by multi-valued (for example, four-valued) dots including the complementing dots Dco is formed on the recording medium 400, and the printing process ends. When dots that are not formed in the original data 300 are newly formed, the new dots serve as the complementing dots Dco. When dots that are formed in the original data 300 are increased in size, the dots increased in size serve as the complementing dots Dco.

FIG. 1 schematically illustrates the dots DT that are formed on the recording medium 400 when the failed nozzle K3 exists in the inclined head 61. Dots from the nozzles C3, M3, and Y3 that correspond to the failed nozzle K3 are formed in the printing image 330 illustrated in FIG. 1. Since the head 61 is inclined clockwise to the right, the position of forming of dots (C3, M3, and Y3) is displaced to the primary vicinity raster RA1 side from the expected position of forming of a dot by the failed nozzle K3. The recording apparatus 1 also forms dots from the nozzles C4 and M4 that are further on the primary vicinity raster RA2 side than the failed nozzle K3. Thus, the complementing dots Dco from the nozzle group NZG are less biased in the missing raster RAL. Therefore, the streak 800 caused by the failed nozzle LN is suppressed in a preferred manner even when the recording head 61 is inclined. In addition, shifting of the color of the composite black dot Dco caused by the inclination of the recording head 61 is also suppressed.

Furthermore, the above processes can be performed through a light process of only substituting the recording density of color ink in the missing raster and the vicinity raster with reference to the table. Thus, this process rarely influences the throughput of data processing, and it is not necessary to prepare subnozzles for use instead of the nozzles for K. Therefore, a decrease in the printing speed is suppressed even when a failed nozzle occurs in a case where high-speed printing is required in a line printer and the like.

As illustrated in FIGS. 1 and 5, the distribution ratio R31 that corresponds to the corresponding nozzle C3 between the nozzles C3 and C4 in the first nozzle set which is far from the nozzle array 68K is less than the distribution ratio R41 that corresponds to the corresponding nozzle M3 between the nozzles M3 and M4 in the second nozzle set which is close to the nozzle array 68K. When the recording densities of complementing color inks that are collectively assigned to each of the nozzles C3 and C4 in the first nozzle set are the same as the recording densities of complementing color inks that are collectively assigned to each of the nozzles M3 and M4 in the second nozzle set, the ratio of occurrence of the dot (C3) that is further displaced to the primary vicinity raster RA1 side than the dot (M3) is less than the ratio of occurrence of the dot (M3), and instead, the ratio of occurrence of the dot (C4) is greater than the ratio of occurrence of the dot (M4). Therefore, dots that are to be formed by the failed nozzle K3 are complemented in a preferred manner.

Furthermore, as illustrated in FIGS. 1 and 5, the recording densities of complementing color inks that are collectively assigned to each of the nozzles C3 and C4 in the first nozzle set which is far from the nozzle array 68K are distributed to each of the nozzles C3 and C4 in the first nozzle set, and the recording density of complementing color ink that is assigned to the third nozzle Y3 which is close to the nozzle array 68K is not distributed. When the recording densities of complementing inks that are collectively assigned to each of the nozzles C3 and C4 in the first nozzle set are the same as the recording density of complementing color ink that is assigned to the third nozzle Y3, the ratio of occurrence of the dot (C3) that is further displaced to the primary vicinity raster RA1 side than the dot (Y3) is less than the ratio of occurrence of the dot (Y3), and the dot (C4) occurs instead. Therefore, dots that are to be formed by the failed nozzle K3 are complemented in a preferred manner.

Dots that are to be formed by the failed nozzle K3 are further complemented in a preferred manner when the recording density of complementing color ink that is used in recording by each nozzle in the nozzle set becomes the distribution ratio that is in accordance with the amount of inclination θ with respect to the reference of the line-up direction D1 of the nozzle array 68 as illustrated in FIGS. 10 to 11E.

The composite conversion in S112 can be performed concurrently with the distribution in S114. In this case, when the CMY correction value table T1 and the distribution ratio table T2 are merged to generate a merged table, the gradation value for K ink GKi in the original data 300 can be directly converted into the gradation value for color ink for each nozzle in the nozzle group NZG by referring to the merged table. Therefore, the recording data 310 can be generated by adding the gradation value for color ink for each nozzle in the nozzle group NZG to the gradation value at the pixels in the original data 300 within the range less than or equal to the upper limit of 255.

(3) Modification Example

The invention can be considered with various modification examples.

For example, printers to which the present technology can be applied include not only a line printer but also a serial printer. In a serial printer, a head moves while a recording medium does not move when dots are formed by discharging ink droplets. Therefore, relative movement of the head and the recording medium includes a case where the recording medium moves while the head does not move and a case where the head moves while the recording medium does not move. In a case of performing band printing that forms all dots in one band corresponding to a nozzle array by performing main scanning once on the recording medium with nozzle arrays for CMYK, a relationship between each nozzle and each raster is the same as those illustrated in FIG. 1 and the like. In a case of performing interlaced printing that discharges ink droplets from nozzle arrays by repeating a process of transporting the recording medium in the transport direction and moving the nozzle arrays for CMYK in the relative movement direction in a reciprocating manner, composite black complementing dots can be formed by the nozzle group including a plurality of nozzles positioned differently in the line-up direction even though nozzles forming dots in the primary vicinity raster are not adjacent to the failed nozzle in the line-up direction. Even in a case of performing pseudo-band printing that forms all dots in one band corresponding to a nozzle array by performing main scanning twice or more on the recording medium with the nozzle arrays for CMYK, composite black complementing dots can be formed by the nozzle group including a plurality of nozzles positioned differently in the line-up direction.

Recording apparatuses to which the present technology can be applied include a photocopier, a facsimile, and the like.

Types of ink include not only liquids intended for representing colors but also various liquids having certain functions such as an uncolored liquid that gives out glossiness. Therefore, ink droplets include various liquid droplets such as uncolored liquid droplets.

The fundamental effect of the present technology is obtained even in a recording apparatus in which the failed nozzle detector U3 is not disposed.

Figure 16:
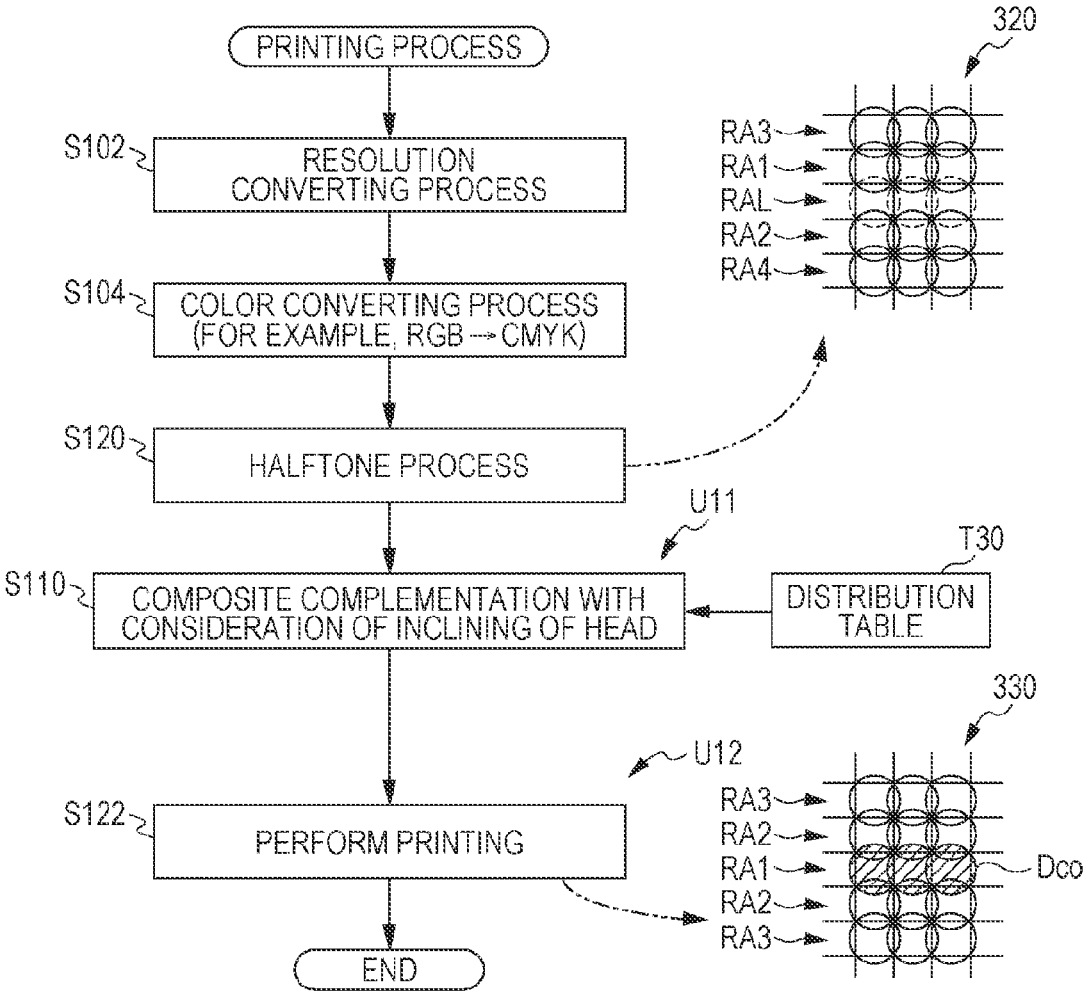
FIG. 16 is a flowchart illustrating a modification example of the printing process.

As described above, the recording density in the present technology means a probability of forming a dot at a pixel after halftone. From this, it is also possible to perform the composite complementation by the complementing unit U11 after the halftone process in S120 as illustrated in FIG. 16. In this case, the halftone data 315 generated by the halftone processing unit 43 serves as the original data 300, and the complementing unit U11 treats the original data 300 and the recording data 310 as multi-valued data such as four-valued data. In FIG. 16, the controller 10 performing the process of S110 constitutes the complementing unit U11, and the controller 10 and the mechanism unit 50 performing the process of S122 constitute the dot forming unit U12.

FIG. 17 illustrates an example of a distribution table T30 that is used in the process of S110. The distribution table T30 is used for distributing complementing dots to each nozzle in the nozzle set (for example, the nozzle sets NZ1 and NZ2 illustrated in FIG. 1) when the original data 300 is four-valued data. FIG. 17 also illustrates how the recording data 310 is generated from the original data 300 when complementing dots are distributed to the lower raster by 50%. The distribution table T30 is disposed depending on the distribution ratio of complementing dots and actually stores information that is in accordance with the amount of inclination θ.

The distribution table T30 represents which pixels for color ink are assigned with dots that are to be formed by the failed nozzle LN for K. In FIG. 17, "+1" means adding one to the four-valued pixel value in the original data 300 within a range of the upper limit less than or equal to three to obtain the pixel value in the recording data 310, and "0" means using the pixel value in the original data 300 as the pixel value in the recording data 310. The "upper 50% distribution table" is an information table in which the probability of adding one to the pixel value in each of the upper raster (RA1) and the missing raster RAL is 50%. The "upper 25% distribution table" is an information table in which the probability of adding one to the pixel value in the upper raster (RA1) is 25%, and the probability of adding one to the pixel value in the missing raster RAL is 75%. The "lower 25% distribution table" is an information table in which the probability of adding one to the pixel value in the lower raster (RA2) is 25%, and the probability of adding one to the pixel value in the missing raster RAL is 75%. The "lower 50% distribution table" is an information table in which the probability of adding one to the pixel value in each of the lower raster (RA2) and the missing raster RAL is 50%. For example, the "upper 50% distribution table" may be used in a case of $\theta(-3)\leq\theta<\theta(-2)$ for the nozzle for C 68C, and the "upper 25% distribution table" may be used in a case of $\theta(-2)\leq\theta<\theta(-1)$. Distribution tables may not be used in a case of $\theta(-1)\leq\theta\leq\theta(1)$. The "lower 25% distribution table" may be used in a case of $\theta(1)<\theta\leq\theta(2)$. The "lower 50% distribution table" may be used in a case of $\theta(2)<\theta\leq\theta(3)$. That is to say, the distribution table is disposed depending on the amount of inclination θ of the head 61.

An example is assumed that the four-valued original data 300 illustrated in FIG. 17 when the "lower 50% distribution table" is set is generated from the CMYK data, and dots are to be formed by the failed nozzle LN for K at all of the pixels in the missing raster in the original data 300. Each pixel in the recording data 310 that is generated in accordance with the "lower 50% distribution table" has a value obtained by adding the pixel value in the original data 300 to the pixel value in the "lower 50% distribution table" within a range less than or equal to three. The complementing dots Dco are formed at the circled pixels in the recording data 310 illustrated in FIG. 17.

Accordingly, the composite black dots Dco are formed in the missing raster RAL by ink droplets from the nozzle group NZG that includes a plurality of nozzles positioned differently in the line-up direction D1. Thus, streaks caused by the failed nozzle LN for K are suppressed in a preferred manner even when the recording head 61 is inclined.

The distribution table T30 illustrated in FIG. 17 is for illustrative purposes only. The distribution table is not limited to an information table storing only "0" and "+1" and may be an information table storing "+2" in addition to "0" and "+1" and the like.

When the recording apparatus 1 can receive input of information representing the amount of inclination θ of the head 61, the distribution ratio table T2 can be reset even in a case where the amount of inclination θ is changed by a serviceman or a user replacing the head 61. Thus, accuracy of complementation of dots that are to be formed by the failed nozzle LN can be favorably maintained.

Figure 18:
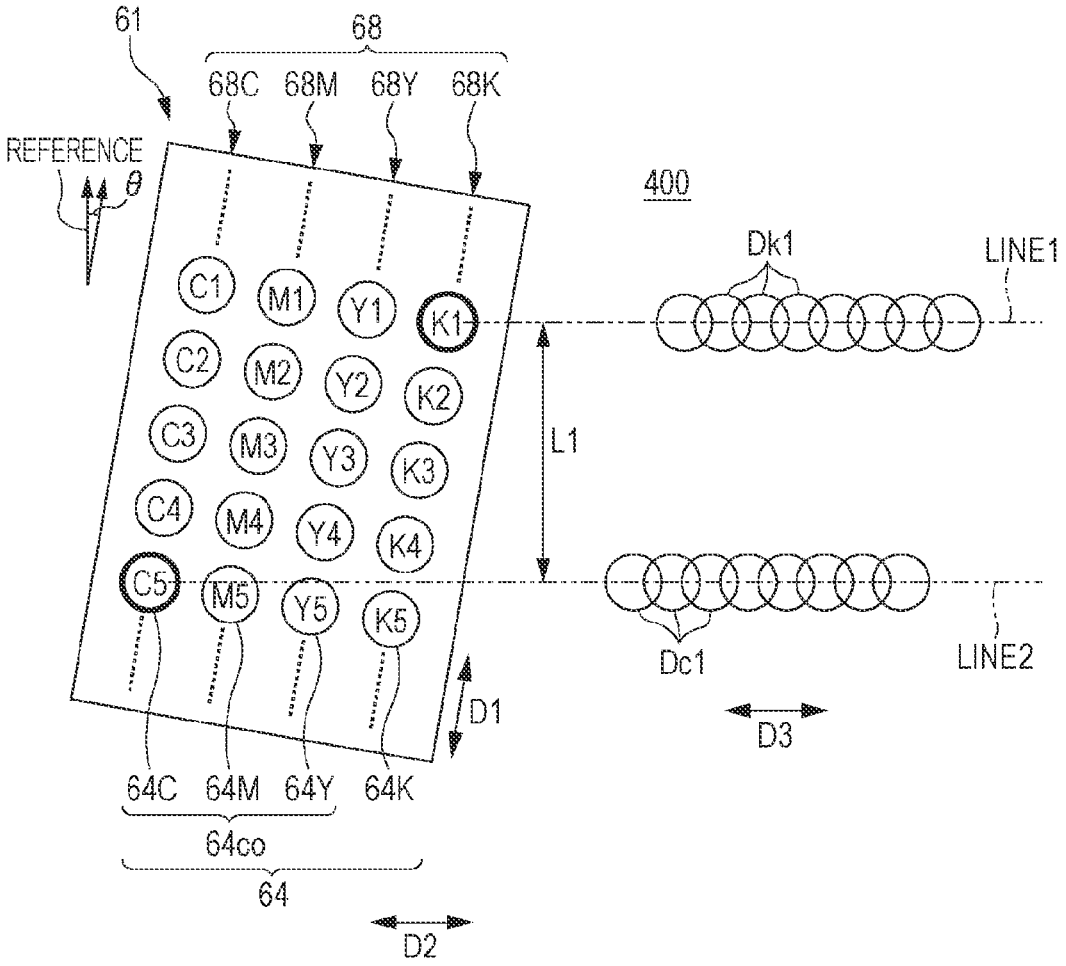
FIG. 18 is a schematic diagram illustrating an example of obtaining information that represents the amount of inclination of a nozzle array with respect to a reference.

FIG. 18 schematically illustrates an example of obtaining information that represents the amount of inclination θ with respect to the reference of the head 61. In this example, the nozzle for K K1 and the nozzle for C C5 continuously discharge ink droplets so as to form lines LINE1 and LINE2 with dots Dk1 and Dc1 during transport of the recording medium 400 in the transport direction D3 (relative movement of the head 61 in the relative movement direction D2). A distance L1 between these lines LINE1 and LINE2 is information representing the amount of inclination θ. The distance L1 is small as the amount of inclination θ is greater and is great as the amount of inclination θ is smaller. Therefore, the amount of inclination θ is obtained when the distance L1 between the lines LINE1 and LINE2 is obtained, and the distribution ratio table T2 that is in accordance with the amount of inclination θ can be determined and stored on the non-volatile memory 30. In addition, as illustrated in FIGS. 20A to 20E, the distribution ratio table may be prepared in a stepwise manner, depending on the distance L1.

Various combinations are apparently available for nozzles forming lines. For example, the nozzle for K K5 and the nozzle for C C1 may continuously discharge ink droplets to form lines during the transport of the recording medium 400. The distance between these lines is great as the amount of inclination θ is greater and is small as the amount of inclination θ is smaller.

In addition, an error in the amount of inclination θ to obtain can be decreased by obtaining multiple number of distances between lines that are formed by a greater number of nozzles discharging ink droplets continuously.

Figure 19:
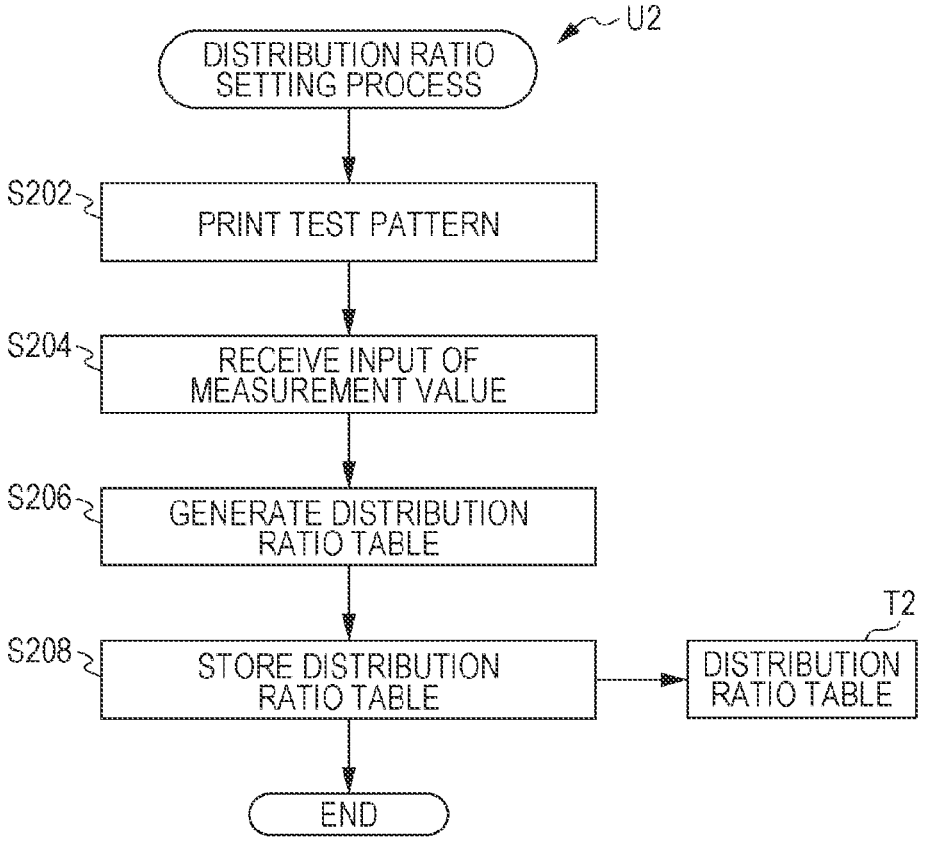
FIG. 19 is a flowchart illustrating an example of a distribution ratio setting process.

FIG. 19 illustrates an example of a distribution ratio setting process of setting the distribution ratio table T2. The controller 10 performing the distribution ratio setting process constitutes the inclination amount input unit U2 along with the operating panel 73 and the mechanism unit 50.

When the distribution ratio setting process starts, the recording apparatus 1 forms a test pattern illustrated in FIG. 18. For example, the test pattern is the lines LINE1 and LINE2 that are configured of the dots Dk1 and Dc1 which are formed by ink droplets discharged continuously from the nozzles K1 and C5 during the transport of the recording medium 400 (S202). A user may measure the distance L1 between the lines LINE1 and LINE2. Next, the recording apparatus 1 receives input of a measured value of the distance L1 from the operating panel 73 (S204). The recording apparatus 1 selects the distribution ratio table T2 that is in accordance with the distance L1 from, for example, the distribution ratio tables illustrated in FIGS. 20A to 20E (S206).

The distribution ratio tables illustrated in FIGS. 20A to 20E are divided in a stepwise manner for thresholds L(1) to L(6) satisfying the relationship of $0<L(1)<L(2)<L(3)<L(4)<L(5)<L(6)$. In the examples illustrated in FIGS. 20A to 20E, the distribution ratio table illustrated in FIG. 20A is selected in a case of L(1)≤L1<L(2). The distribution ratio table illustrated in FIG. 20B is selected in a case of L(2)≤L1<L(3). The distribution ratio table illustrated in FIG. 20C is selected in a case of L(3)≤L1≤L(4). The distribution ratio table illustrated in FIG. 20D is selected in a case of L(4)<L1≤L(5). The distribution ratio table illustrated in FIG. 20E is selected in a case of L(5)<L1≤L(6). Apparently, the distribution ratio tables illustrated in FIGS. 20A to 20E are for illustrative purposes only.

Last, the controller 10 stores the selected distribution ratio table T2 on the non-volatile memory 30 (S208). The distance L1 and the amount of inclination θ has a correspondence of 1:1. Thus, the recording density of complementing color ink that is used in recording by each nozzle becomes the distribution ratio that is in accordance with the amount of inclination θ represented by information which is input to the inclination amount input unit U2.

Accordingly, by inputting information that represents the amount of inclination θ, the complementing recording density that is distributed to each nozzle becomes the distribution ratio that is in accordance with the amount of inclination θ which is represented by the newly inputted information even when the amount of inclination θ is changed by a serviceman and the like replacing the head 61. Therefore, the present modification example can improve convenience of use and maintain the effect of suppressing streaks caused by the failed nozzle LN for K in a preferred manner.

(4) Conclusion

According to the invention, as described hereinbefore, various embodiments can provide a technology and the like that can appropriately complement dots which are to be formed by a failed nozzle for black without preparing subnozzles used instead of the nozzles for black. Apparently, the fundamental action and the effect described above are obtained with a technology and the like that only include elements which are in accordance with independent claims and do not include elements which are in accordance with dependent claims.

In addition, it is also possible to embody a configuration in which the configurations disclosed in the above embodiment and the modification example are substituted with each other, or the combination thereof is changed, a configuration in which technologies in the related art and the configurations disclosed in the above embodiment and the modification example are substituted with each other, or the combination thereof is changed, and the like. The invention also includes these configurations and the like.

What is claimed is:

1. A recording apparatus in which a recording medium and a plurality of nozzles including a plurality of nozzles for black which is lined up in a predetermined line-up direction to form black dots and a plurality of nozzles for color which is lined up in the line-up direction to form cyan, magenta and yellow color dots and composite black dots move relatively in a relative movement direction that is different from the line-up direction, the recording apparatus comprising:

a processing unit that forms composite black dots with a nozzle group included in the plurality of nozzles for color which forms the cyan, magenta and yellow color dots and at least one additional color dot, which is formed by a different nozzle positioned differently in the line-up direction, among the cyan, magenta and yellow color dots to complement dot loss pixels where the black dots are supposed to be formed by one failed nozzle included in the plurality of nozzles for black, wherein the processing unit includes:

a complementing unit that generates, on the basis of original data before complementation of the dot loss pixels where the black dots are supposed to be formed by the failed nozzle, recording data in which composite black dots that complement the dot loss pixels where the black dots are supposed to be formed by the failed nozzle are formed, and a dot forming unit that forms dots with the plurality of nozzles on the basis of the recording data, the complementing unit converts, among recording densities of black ink represented in the original data, a recording density of black ink that is used in recording by the failed nozzle into a recording density of complementing color ink that is used in recording by the nozzle group and generates the recording data that includes the obtained recording density of complementing color ink, and wherein the complementing unit sets the recording density of complementing color ink used in recording by each of the plurality of nozzles that is included in the nozzle group and is positioned differently in the line-up direction to a distribution ratio that is in accordance with an amount of inclination with respect to a reference of the line-up direction of the plurality of nozzles for black and the plurality of nozzles for color.

2. The recording apparatus according to claim 1, wherein the nozzle group includes a first nozzle set that is a plurality of nozzles positioned differently in the line-up direction at a predetermined distance from the array of the plurality of nozzles for black and a second nozzle set that is a plurality of nozzles positioned differently in the line-up direction closer to the plurality of nozzles for black than the first nozzle set, and the complementing unit sets, among the distribution ratio of the recording density of complementing color ink used in recording by each nozzle in the first nozzle set, a distribution ratio corresponding to a nozzle that has the same position as the failed nozzle in the line-up direction to be less than, among the distribution ratio of the recording density of complementing color ink used in recording by each nozzle in the second nozzle set, a distribution ratio corresponding to a nozzle that has the same position as the failed nozzle in the line-up direction.

3. The recording apparatus according to claim 1, wherein the nozzle group includes a first nozzle set that is a plurality of nozzles positioned differently in the line-up direction at a predetermined distance from the array of the plurality of nozzles for black and a third nozzle that has the same position as the failed nozzle in the line-up direction and is closer to the plurality of nozzles for black than the first nozzle set, and the complementing unit distributes the recording density of complementing color ink that is collectively assigned to the first nozzle set to each nozzle in the first nozzle set and does not distribute the recording density of complementing color ink that is collectively assigned to the third nozzle.

4. The recording apparatus according to claim 1, wherein the recording data is gradation data that represents the recording density of black ink and color ink, and the dot forming unit decreases the number of gradations in the gradation data to generate halftone data that represents a forming status of dots and forms dots with the plurality of nozzles on the basis of the halftone data.

5. The recording apparatus according to claim 1, further comprising:

an inclination amount input unit that receives input of information which represents an amount of inclination with respect to a reference of the line-up direction of the plurality of nozzles for black and the plurality of nozzles for color, wherein the complementing unit sets the recording density of complementing color ink used in recording by each of the plurality of nozzles that is included in the nozzle group and is positioned differently in the line-up direction to a distribution ratio that is in accordance with the amount of inclination represented by the information which is input to the inclination amount input unit.

6. A recording method that forms dots by relatively moving a recording medium and a plurality of nozzles including a plurality of nozzles for black that is lined up in a predetermined line-up direction to form black dots and a plurality of nozzles for color that is lined up in the line-up direction to form cyan, magenta and yellow color dots and composite black dots in a relative movement direction that is different from the line-up direction, the recording method comprising:

forming composite black dots with a nozzle group that is included in the plurality of nozzles for color which forms the cyan, magenta and yellow color dots and at least one additional color dot, which is formed by a different nozzle positioned differently in the line-up direction, among the cyan, magenta and yellow color dots to complement dot loss pixels where the black dots are supposed to be formed by one failed nozzle included in the plurality of nozzles for black;

generating, on the basis of original data before complementation of the dot loss pixels where the black dots are supposed to be formed by the failed nozzle, recording data in which composite black dots that complement the dot loss pixels where the black dots are supposed to be formed by the failed nozzle are formed;

forming dots with the plurality of nozzles on the basis of the recording data; and converting, among recording densities of black ink represented in the original data, a recording density of black ink that is used in recording by the failed nozzle into a recording density of complementing color ink that is used in recording by the nozzle group and generates the recording data that includes the obtained recording density of complementing color ink, wherein the recording density of complementing color ink used in recording is set by each of the plurality of nozzles that is included in the nozzle group and is positioned differently in the line-up direction to a distribution ratio that is in accordance with an amount of inclination with respect to a reference of the line-up direction of the plurality of nozzles for black and the plurality of nozzles for color.

7. The recording method according to claim 6, wherein the nozzle group includes a first nozzle set that is a plurality of nozzles positioned differently in the line-up direction at a predetermined distance from the array of the plurality of nozzles for black and a second nozzle set that is a plurality of nozzles positioned differently in the line-up direction closer to the plurality of nozzles for black than the first nozzle set, and among the distribution ratio of the recording density of complementing color ink used in recording by each nozzle in the first nozzle set, a distribution ratio is set to correspond to a nozzle that has the same position as the failed nozzle in the line-up direction to be less than, among the distribution ratio of the recording density of complementing color ink used in recording by each nozzle in the second nozzle set, a distribution ratio corresponding to a nozzle that has the same position as the failed nozzle in the line-up direction.

8. The recording method according to claim 6, wherein the nozzle group includes a first nozzle set that is a plurality of nozzles positioned differently in the line-up direction at a predetermined distance from the array of the plurality of nozzles for black and a third nozzle that has the same position as the failed nozzle in the line-up direction and is closer to the plurality of nozzles for black than the first nozzle set, and the recording density of complementing color ink that is collectively assigned to the first nozzle set is distributed to each nozzle in the first nozzle set, and the recording density of complementing color ink that is collectively assigned to the third nozzle is not distributed.

9. The recording method according to claim 6, wherein the recording data is gradation data that represents the recording density of black ink and color ink, and the number of gradations in the gradation data is decreased to generate halftone data that represents a forming status of dots and forms dots with the plurality of nozzles on the basis of the halftone data.

10. The recording method according to claim 6, further comprising:

receiving input of information which represents an amount of inclination with respect to a reference of the line-up direction of the plurality of nozzles for black and the plurality of nozzles for color, wherein the recording density of complementing color ink used in recording by each of the plurality of nozzles that is included in the nozzle group and is positioned differently in the line-up direction is set to a distribution ratio that is in accordance with the amount of inclination represented by the information which is input.

11. A recording apparatus in which a recording medium and a plurality of nozzles including a plurality of nozzles for black which is lined up in a predetermined line-up direction to form black dots and a plurality of nozzles for color which is lined up in the line-up direction to form composite black dots move relatively in a relative movement direction that is different from the line-up direction, the recording apparatus comprising:

a processing unit that forms composite black dots with a nozzle group included in the plurality of nozzles for color to complement dots which are to be formed by a failed nozzle included in the plurality of nozzles for black, wherein the nozzle group includes a plurality of nozzles that is positioned differently in the line-up direction, wherein the processing unit includes:

a complementing unit that generates, on the basis of original data before complementation of dots that are to be formed by the failed nozzle, recording data in which composite black dots that complement dots which are to be formed by the failed nozzle are formed; and a dot forming unit that forms dots with the plurality of nozzles on the basis of the recording data, the complementing unit converts, among recording densities of black ink represented in the original data, a recording density of black ink that is used in recording by the failed nozzle into a recording density of complementing color ink that is used in recording by the nozzle group and generates the recording data that includes the obtained recording density of complementing color ink, and the complementing unit sets the recording density of complementing color ink used in recording by each of the plurality of nozzles that is included in the nozzle group and is positioned differently in the line-up direction to a distribution ratio that is in accordance with an amount of inclination with respect to a reference of the line-up direction of the plurality of nozzles for black and the plurality of nozzles for color.

12. The recording apparatus according to claim 11, wherein the nozzle group includes a first nozzle set that is a plurality of nozzles positioned differently in the line-up direction at a predetermined distance from the array of the plurality of nozzles for black and a second nozzle set that is a plurality of nozzles positioned differently in the line-up direction closer to the plurality of nozzles for black than the first nozzle set, and the complementing unit sets, among the distribution ratio of the recording density of complementing color ink used in recording by each nozzle in the first nozzle set, a distribution ratio corresponding to a nozzle that has the same position as the failed nozzle in the line-up direction to be less than, among the distribution ratio of the recording density of complementing color ink used in recording by each nozzle in the second nozzle set, a distribution ratio corresponding to a nozzle that has the same position as the failed nozzle in the line-up direction.

13. The recording apparatus according to claim 11, wherein the nozzle group includes a first nozzle set that is a plurality of nozzles positioned differently in the line-up direction at a predetermined distance from the array of the plurality of nozzles for black and a third nozzle that has the same position as the failed nozzle in the line-up direction and is closer to the plurality of nozzles for black than the first nozzle set, and the complementing unit distributes the recording density of complementing color ink that is collectively assigned to the first nozzle set to each nozzle in the first nozzle set and does not distribute the recording density of complementing color ink that is collectively assigned to the third nozzle.

14. The recording apparatus according to claim 11, wherein the recording data is gradation data that represents the recording density of black ink and color ink, and the dot forming unit decreases the number of gradations in the gradation data to generate halftone data that represents a forming status of dots and forms dots with the plurality of nozzles on the basis of the halftone data.

15. The recording apparatus according to claim 11, further comprising:

an inclination amount input unit that receives input of information which represents the amount of inclination with respect to the reference of the line-up direction of the plurality of nozzles for black and the plurality of nozzles for color, wherein the complementing unit sets the recording density of complementing color ink used in recording by each of the plurality of nozzles that is included in the nozzle group and is positioned differently in the line-up direction to the distribution ratio that is in accordance with the amount of inclination represented by the information which is input to the inclination amount input unit.

* * * * *